US007343715B2

(12) United States Patent
Ito et al.

(10) Patent No.: US 7,343,715 B2
(45) Date of Patent: Mar. 18, 2008

(54) SOUND-PROOF WALL MADE OF FRP, AND METHOD OF PRODUCING THE SAME

(75) Inventors: Toshihiro Ito, Otsu (JP); Yutaka Ochi, Kyoto (JP); Toru Kato, Iyo-gun (JP); Hiroshi Odani, Iyo-gun (JP); Shintaro Tanaka, Iyo-gun (JP); Kousuke Yoshimura, Otsu (JP); Atsushi Ochi, Otsu (JP); Kimio Mitani, Kawanishi (JP)

(73) Assignee: Toray Industries, Inc. (JP)

( * ) Notice: Subject to any disclaimer, the term of this patent is extended or adjusted under 35 U.S.C. 154(b) by 694 days.

(21) Appl. No.: 10/477,604

(22) PCT Filed: May 15, 2002

(86) PCT No.: PCT/JP02/04703

§ 371 (c)(1),
(2), (4) Date: Nov. 14, 2003

(87) PCT Pub. No.: WO02/095135

PCT Pub. Date: Nov. 28, 2002

(65) Prior Publication Data

US 2004/0128947 A1 Jul. 8, 2004

(30) Foreign Application Priority Data

May 17, 2001 (JP) ..... 2001-148164
May 17, 2001 (JP) ..... 2001-148166
Nov. 22, 2001 (JP) ..... 2001-357068

(51) Int. Cl.
*E04C 1/00* (2006.01)

(52) U.S. Cl. ..... 52/309.16; 52/309.1; 52/309.14; 52/309.15; 52/790.1; 52/794.1; 52/793.1; 428/120; 428/137; 428/56; 428/174; 428/314.4; 428/309.9; 428/316.6

(58) Field of Classification Search ..... 428/174, 428/178, 188, 131, 137, 56, 120, 309.9, 314.4, 428/316.6; 52/782.1, 790.1, 794.1, 793.1, 52/309.1, 309.4, 309.15, 309.16, 309.14
See application file for complete search history.

(56) References Cited

U.S. PATENT DOCUMENTS 2,981,382 A * 4/1961 Keller ..... 52/309.15

(Continued)

FOREIGN PATENT DOCUMENTS

JP 3551147098 A * 11/1980
JP 60-199149 10/1985
JP 10-37135 A 2/1998
JP 10-121599 5/1998
JP 11-310906 A 11/1999

(Continued)

OTHER PUBLICATIONS

JP355147098A, Nov. 15, 1080, Mitsubishi Electronic Corp, Applicant: ONO□□□□JP 363005921A, Jan. 11, 1998, Applicant: Nakao et al, Tkiron Co Ltd.*

(Continued)

*Primary Examiner*—Jeanette Chapman
(74) *Attorney, Agent, or Firm*—DLA Piper US LLP

(57) ABSTRACT

A sound-proof wall made of FRP in the form of a sound-proof wall panel that includes a core and skin members made of FRP positioned on both sides of the core and whose weight per nit area is within the range of 10-60 kg/m$^2$; and a method of producing the same. This sound-proof wall, though light in weight, has a superior sound insulation property and will never corrode because it is made of FRP. Further, it has a high degree of freedom of engineering design including sound-proof property, design, and shape, capable of producing a desired sound-proof wall with case. Further, since it has a high specific strength, it is possible to attain a drastic weight reduction while retaining the necessary strength, and facilitate working, shorten construction time, and reduce construction cost.

23 Claims, 13 Drawing Sheets

U.S. PATENT DOCUMENTS

| | | | | | |
|---|---|---|---|---|---|
| 4,001,473 | A | * | 1/1977 | Cook | 428/116 |
| 4,384,020 | A | * | 5/1983 | Beggs et al. | 428/138 |
| 5,150,944 | A | * | 9/1992 | Yoshida et al. | 296/203.01 |
| 5,224,315 | A | * | 7/1993 | Winter, IV | 52/309.8 |
| 5,373,674 | A | * | 12/1994 | Winter, IV | 52/309.9 |
| 5,438,171 | A | | 8/1995 | Schmanski | |
| 5,834,082 | A | * | 11/1998 | Day | 428/56 |
| 5,883,021 | A | * | 3/1999 | Beer et al. | 442/172 |
| 5,912,442 | A | * | 6/1999 | Nye et al. | 181/292 |
| 5,979,684 | A | * | 11/1999 | Ohnishi et al. | 220/1.5 |
| 6,227,125 | B1 | * | 5/2001 | Schroeder et al. | 105/401 |
| 6,942,915 | B1 | * | 9/2005 | Kondo et al. | 428/174 |
| 2001/0031350 | A1 | * | 10/2001 | Day et al. | 428/317.9 |

FOREIGN PATENT DOCUMENTS

| | | | |
|---|---|---|---|
| JP | 2000-052371 | A | 2/2000 |
| JP | 2000-87317 | A | 3/2000 |
| JP | 2000-96522 | | 4/2000 |
| JP | 2000-319822 | A | 11/2000 |
| JP | 2000-336621 | | 12/2000 |
| JP | 2002-88721 | A | 3/2002 |

OTHER PUBLICATIONS

Derwent Acc No. 2004-046371, Toray Ind, Nov. 14, 2001,.
□□□□Derwent Acc No. 2000-359687, Nippon Polyester KK, Oct. 15, 1998.*
Derwent Acc No. 1994-114830, Sumitomo Chem Co Ltd, Aug. 12, 1992.*
JP2002337158A, Nov. 27, 2002, Toray Ind, Applicant: Ochi et al.*

* cited by examiner

FIG. 19

| | Sample | Structure of panel | Thickness of skin member t1 (mm) | Total thickness T (mm) | Thickness ratio $\beta = T/(2 \cdot t1)$ | Weight Wt (kg/m$^2$) |
|---|---|---|---|---|---|---|
| Example 4 | Panel 1 | A B C CR1 (t = 180) C B A | 3 | 186 | 31.0 | 15.8 |
| | Panel 2 | A B C CR1 (t = 50) C B A | 3 | 56 | 9.3 | 13.6 |
| | Panel 3 | A B C CR1 (t = 15) C B A | 3 | 21 | 3.5 | 10.8 |
| | Panel 4 | A B C CRB (t = 38) C B A | 3 | 44 | 7.4 | 14.6 |
| | Single plate 1 | A B C C B A | 3 | 6 | 1.0 | 10.2 |
| Comparative Example 3 | Single plate 2 | A B' C' C' B' A | 2 | 4 | 1.0 | 6.8 |

SOUND-PROOF WALL MADE OF FRP, AND METHOD OF PRODUCING THE SAME

TECHNICAL FIELD

This disclosure relates to a sound-proof wall made of a fiber reinforced plastic (hereinafter, referred to as "FRP") provided to railways, roads, etc., for the purpose of insulating noises generated by trains and cars, and a method for producing the same.

BACKGROUND

Noises induce complains and troubles most frequently among various pollutions, and prevention of noise as a countermeasure against an environmental problem is an important social subject.

Generally, there are two kinds of members of a sound insulation member and a sound absorbing member as sound-proof members for preventing noise.

The sound insulation member functions to cut the propagation of sound energy by reflecting a sound propagated in air, and the sound transmission loss, which is an index of the sound insulation property, basically depends on mass low, and becomes greater as the mass becomes greater. For example, mainly a concrete sound-proof panel or a metal sound-proof panel, such as those disclosed in, for example, JP-A-8-144227, is installed on a lowland portion or a high-level portion of a railway or a road for the purpose of reducing noise to inhabitants in the regions along the railway or road, as known well.

Since such panels made of these materials are heavy, although they have certain effects for preventing or diffusing noise generated from trains or cars depending on mass low, in a case of a metal sound-proof panel, there is a problem in durability such as deterioration, and in a case of a concrete sound-proof panel, recently there is a problem of flaking of small concrete pieces due to bulging or cracking caused by caustic embrittlement or rust of reinforcing steel. In particular, in a case of sound-proof walls made of concrete blocks, damage to the walls such as cracks and gaps is severe, and in a case where the installation place is at a high level such as a high-level bridge of a railway, flaking thereof becomes a problem, and therefore, urgent exchange is considered to be necessary.

Further, because the walls in both cases are great in specific gravity and heavy (for example, about 200 to 300 kg/m as a weight per unit length in the horizontal direction in an installation place), it is necessary to introduce heavy machines and an exclusive machine for attachment into an attachment place for conveying and attaching the walls. Especially, in a case where the installation place is a high-level bridge of railway, there remain a problem that it is difficult to approach the exclusive construction machine to the installation place of sound-proof walls from the railway line side, and a problem in workability because, even if the approach becomes possible, the work for installation inevitably becomes a high-level place working from a position under the high-level bridge.

For such problems, sound-proof panels made of FRP containing light-weight cores for the purpose of lightening are disclosed in JP-B-2-57691 and JP-A-9-170292. In these publications, because the use of sound-proof panels are limited mainly to outer walls of houses and buildings, the sound-proof panels disclosed in these publications are designed for a case where a noise source is relatively far, and they are not so high in sound insulation property. Further, small beams for attachment of the panels are provided in the lengthwise and crosswise directions at a fine pitch, and they are constructed as those which do not require high mechanical properties such as strength and stiffness so much.

However, in order to use the sound-proof panels as those for railways or roads, because noise sources are relatively close and the noise levels are high, it is necessary to control their weights at proper weights based on mass low. At the same time, it is preferred to sustain a panel by itself without providing small beams at a fine pitch, and because a wind pressure is applied, it is necessary to bear a wind pressure in the range of about 300 kg/m$^2$ to about 400 kg/m$^2$ per unit area. Namely, a light-weight sound-proof panel cannot be obtained unless an optimum design is performed with respect to sound insulation property and strength while an attachment means to a construction body such as a high-level bridge, a bridge or an edge of a road is considered. Further, in a case where the installation place is a high-level bridge such as a high-level bridge of railway, the panel itself may become a great noise source unless a resonance due to a vibration propagated from the construction body when a train is running is avoided.

Further, recently, for a sound-proof panel applied to a railway or a road, sound-proof countermeasures for houses or educational institutions adjacent to the railway or the road are further required, and the height of the sound-proof panel tends to become higher in order to also suppress a diffracted sound. However, the present construction body or beam has a weight limitation ascribed to the viewpoint of strength, and the height of the panel cannot be increased to a height more than a certain level. Further, although a light sound-proof panel made of acrylic is employed in consideration of such a weight limitation, there are a problem of durability due to a strength reduction ascribed to a deterioration by ultraviolet ray in a relatively short period, and a problem that the construction cost is not always cheep as a whole, because the strength and the stiffness are small and it is necessary to provide support poles and cross beams at a small interval though the sound-proof panel itself is light.

On the other hand, since the aforementioned sound absorbing member functions to damp a sound pressure by transforming a sound energy into a thermal energy, the sound absorbing member by itself is low in sound insulation property, and therefore, it is a general use to use it together with a sound insulation member, thereby increasing the sound insulation property. The invention using such a sound absorbing member and increasing the sound insulation property is disclosed in, for example, JP-A-2000-8331.

That invention disclosed is a sound-proof panel having a structure in which the sound insulation portion comprises a concrete sound insulation wall, therebehind an FRP sound absorbing plates are disposed at a predetermined interval, and an air layer is provided therebetween. Although this panel appears to be excellent in sound insulation property, because the sound insulation panel itself is made of concrete, there is still a problem of the aforementioned partial flaking or dropping of small pieces due to caustic embrittlement or temporal deterioration. Although it is tried to cover concrete with glass fiber reinforced plastic and prevent the flaking, it has not yet reached an essential improvement. Further, in a case of new installation, because the panels are made of concrete, heavy machines are required similarly to in the cases aforementioned.

It could therefore be advantageous to provide a sound-proof wall panel made of FRP and a sound-proof wall using this panel which have an effect for preventing a noise or diffusing or absorbing the noise, and do not cause flaking of small pieces due to deterioration thereof as in the conventional sound-proof walls made of concrete, which are light and excellent in handling property, and which can be installed easily even if the installation place is a high-level place, and a method for producing the same.

SUMMARY

We provide a sound-proof wall panel made of FRP comprising a core and skin members made of FRP positioned on both sides of the core, and its weight per unit area is within the range of 10-60 kg/m$^2$.

There are two kinds of members of a sound insulation member and a sound absorbing member as sound-proof materials of the panel for preventing noise, for example, when the above-described panel is formed as a three-layer structure of an FRP sound insulation panel portion, a sound absorbing body and an FRP perforated panel portion, because the energy of a sound entering from the perforated panel portion is damped by the sound absorbing body and the energy is further damped by the sound insulation panel portion, more preferable sound-proof effect can be obtained.

A sound-proof wall made of FRP comprises a support pole provided integrally with the above-described panel, and the support pole supports the panel and ahs an attachment portion attached to a construction at a lower position.

Further, a method for producing a sound-proof wall made of FRP comprises a method for producing a sound-proof wall panel by any of the following molding methods. Namely, a method for producing a sound-proof wall made of FRP comprises the steps for molding a sound-proof wall panel of placing reinforcing fibers for a skin member, which forms a surface of a molded product, in a mold, placing a core, which has a resin channel for distributing an injected resin, on the reinforcing fibers, thereafter placing reinforcing fibers for a skin member, which forms a back surface of the molded product, on the core, and while reducing a pressure in the mold, injecting a matrix resin into the resin channel impregnating and curing the resin. Alternatively, a method for producing a sound-proof wall made of FRP comprises the steps for molding a sound-proof wall panel of placing reinforcing fibers for a skin member, which forms a surface of a molded product, in a mold at a state in which a matrix resin is impregnated into the reinforcing fibers, placing a core, thereafter placing reinforcing fibers for a skin member, which forms a back surface of the molded product, on the core at a state in which a matrix resin is impregnated into the reinforcing fibers, and while reducing a pressure in the mold, curing the matrix resin. Alternatively, a method for producing a sound-proof wall made of FRP comprises the steps for molding a sound-proof wall panel of, after molding a skin member forming a surface of a molded product and a skin member forming a back surface of the molded product separately, forming a hollow structural body by bonding both skin member, and charging a core material into a hollow portion of the hollow structural body. Alternatively, a method for producing a sound-proof wall made of FRP comprises the steps for molding a sound-proof wall panel of forming a hollow structural body by molding a sound-proof wall panel of forming a hollow structural body by molding a skin member forming a surface of a molded product and a skin member forming a back surface of the molded product substantially simultaneously, and charging a core material into a hollow portion of the hollow structural body.

BRIEF EXPLANATION OF THE DRAWINGS

FIG. 19 is a view showing structures of respective samples in Example 4 and Comparative Example 3.

EXPLANATION OF LABELS

Figure 1:
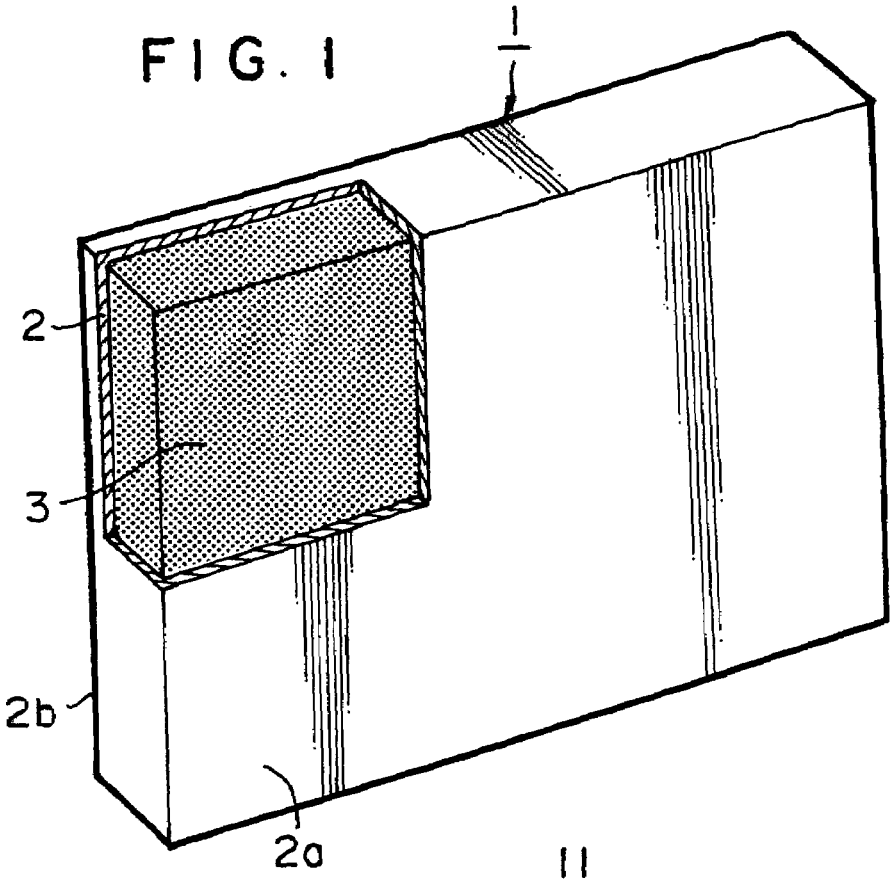
FIG. 1 is a partially cut-away perspective view of an FRP sound-proof wall.

1, 1*a*, 1*b*, 1*c*, 11, 21, 31, 41, 51, 61, 71, 81, 91, 101, 111, 121, 131: sound insulation panel
2, 2*a*, 2*b*, 12, 22, 32, 82, 92, 132: skin member
3, 13, 23, 33, 83, 93, 103, 133: core
4, 24, 103, 139: reinforcing rib
25: hollow portion
34: stiffener
42: support pole
52, 84, 112, 124, 138: pole body
52*a*, 72, 137: attachment portion
63, 73, 125: chemical anchor

64, 74: metal plate
65, 75, 126: nut
62, 76, 123: construction body
66: cover
85: rough surface
86: layer provided for the purpose of forming a rough surface
87: layer provided for the purpose of obtaining strength or stiffness
88: colored layer
94, 104: sound absorbing body
95, 105: perforated panel
96, 106: opening portion
102: FRP single plate
113: folded portion
122: overlapping portion
134: light transmitting material
135: sound insulation body
136: metal frame

DETAILED DESCRIPTION

Hereinafter, desirable embodiments of a sound-proof wall made of fRP and a method for producing the same will be explained referring to the figures.

As aforementioned, there are two kinds of members of a sound insulation member and a sound absorbing member as sound-proof members for preventing noise. A sound-proof wall, which is a first structure, is formed in a structure having a skin member made of FRP in which a sound insulation panel aims only a sound insulation effect, and a core. Further, a second structure of a sound-proof wall is formed in a structure having three layers of the above-described sound insulation panel, a sound absorbing material having a sound absorbing function, and an FRP perforated panel preventing dispersion of the sound absorbing material.

For the sound-proof wall panel, in a case of a relatively low noise level where a desired sound-proof effect can be obtained only by sound insulation, the sound insulation panel may be used solely.

As the matrix resin of FRP portion forming the skin member, for example, a thermoplastic resin such as polyethylene, polypropylene, nylon, ABS, PEEK or polyimide, or a thermosetting resin such as epoxy resin, unsaturated polyester resin, vinylester resin or phenolic resin, can be used.

To these resins, a damping agent such as a stratified compound (for example, mica, molybdenum disulfide, boron nitride, etc.), an acicular compound (for example, xonotlite, potassium titanate, carbon fiber, etc.) or a particulate or plate-like compound (for example, ferrite, talc, clay, etc.) can be added. By adding a damping agent, transformation into frictional heat due to mutual movement between crystals of inorganic substances or between an inorganic substance and a matrix resin is performed, the elastic modulus and the density are increased by charging the above-described filler, the kinetic energy of vibrating materials is extinguished, and the vibration of the panel can be reduced.

Further, a flame retardant (for example, aluminum hydroxide, bromine, inorganic powder, etc.) can be added to the above-described matrix resin to increase the flame resistance. Further, because a phenolic resin as a matrix resin is excellent in flame resistance by itself and it is inexpensive, it is preferably used. The above-described additives may be appropriately selected depending on places to be installed, namely, depending on a place requiring to prevent spreading fire, a place remarkable in propagation of vibration, etc.

As reinforcing fibers for FRB, inorganic fibers such as glass fibers or carbon fibers, or organic fibers such as aramide fibers, nylon fibers or polyester fibers can be used appropriately depending upon the use and the conditions for usage Further, as the formation of the used fibers, for example, a mat comprising short fibers preferably with a fiber length of 1 to 3 mm, a cloth or strand comprising continuous fibers, and the like, can be preferably used.

Although carbon fibers are most preferable as the reinforcing fibers in order to obtain a light-weight and high-strength FRP, hybrid reinforcing fibers of glass fibers and carbon fibers are also preferably used, and the volume ratio is preferably in a range of 1:0.05 to 1:1. Further, there is an advantage for increasing vibration damping property by containing carbon fibers.

Although the kind of used carbon fibers is not particularly restricted from the viewpoint of strength and stiffness, in consideration of lower cost, it is most preferable to use so-called large-tow carbon fibers. For example, it is not to use a usual yarn whose number of filaments per one carbon fiber yarn is less than 10,000, but it is preferable to use a tow-like carbon fiber filamentary yarn whose number of filaments per one yarn is, if possible, in a range of 10,000 to 300,000, more preferably in a range of 50,000 to 150,000, because such a yarn is more excellent in impregnation property of resin, handling property as a reinforcing fiber substrate, and economic condition for a reinforcing fiber substrate.

The above-described mat is obtained by cutting filamentary yarns of glass fibers, carbon fibers, etc. at a length of about 1 mm to about 3 mm and making a sheet form using a binder such as polyvinyl alcohol (PVA), and a flat surface can be obtained by disposing it on a molded product. Further, a cloth substrate comprising warps and wefts is obtained by weaving the above-described filamentary yarns by a weaving machine. The mat substrate may be disposed in order to increase a boundary delamination resistance between layers of a cloth substrate or a unidirectional substrate comprising laminated continuous fibers.

Further, an FRP skin member can be form by various molding methods such as a first-group molding method selected from the group of vacuum, blow, injection, stamping, BMC (bulk molding compound), SMC (sheet molding compound) and transfer molding methods, and a second-group molding method selected from the group of RTM (resin transfer molding), press, pultrusion and hand-lay-up molding methods.

The above-described first-group molding method is a method frequently used in a case of combination of a short fiber substrate and a thermoplastic resin or a thermosetting resin. Although this molding method has a weak point of slightly low strength and stiffness because the used reinforcing fibers are short fibers, it is frequently used because the molding cycle is short, the manufacturing cost is low, and ribs, etc. for giving an excellent function as a structural body can be easily molded, and strength and stiffness much higher than those of a body made of a plastic only can be obtained by this method. The above-described second-group molding method is a method frequently used in a case of combination of a long fiber substrate and a thermosetting resin, and it is possible to form ribs similarly to in the above-described method. In particular, by a vacuum injection and impregnation molding which is a simple RTM, the volume content of reinforcing fibers, etc. can be increased, and there is an advantage that a product having high strength and stiffness can be manufactured relatively inexpensively.

In the above-described substrate, as needed, or in accordance with required mechanical properties, etc., a plurality of reinforcing fiber layers are stacked to form a reinforcing fiber substrate, and a resin is impregnated into the reinforcing fiber substrate. A unidirectional fiber layer or a woven fabric layer can be appropriately employed as the reinforcing fiber layer to be stacked, and it is preferred to appropriately select the direction of the fiber orientation thereof depending upon a required strengthening direction. The volume content of reinforcing fibers Vf in this case is preferably in a range of 15 to 60%, more preferably in a range of 30 to 50%, from the reason to ensure strength and stiffness necessary for an FRP structural body (in this case, a sound-proof panel).

As described above, it could be advantageous to obtain a sound-proof wall light in weight and good in handling without requiring a heavy machine at the time of construction and easy in construction wile ensuring necessary mechanical properties (strength and stiffness), and another purpose is to give an excellent sound insulation property.

From such a point of view, generally, the sound insulation property of a sound insulation material is indicated by a sound transmission loss (TL) defined by an equation of $TL=10 \log_{10}(1/\tau)$ expressed by decibel (dB) as its unit. The transmission rate ($\tau$) is expressed as a ratio of a transmitted energy (It) relative to an incident sound energy (Ii) to the surface of a material and defined as an equation of $\tau=(It/Ii)$, and only a sound transmitted through the material becomes its object. Although usually the transmission loss of a sound insulation material is basically depending on mass law and the greater the mass is, the greater the loss becomes, a transmission loss of 10 dB or more in an audible range of 125 Hz to 4 kHz is required for a sound insulation panel used in a railway or road. Namely, it must be a material capable of insulating 90% or more of a sound energy. In order to achieve this in an FRP sound-proof wall, it is necessary to set the weight of a sound insulation portion at 10 $kg/m^2$ or more, and if the weight is less than this value, a necessary transmission loss cannot be obtained. Although it is possible to use only an FRP single plate having a thickness of 6 mm or more if only the transmission loss is considered, in order to resist against a wind pressure of 300 $kg/m^2$ to 400 $kg/m^2$ per unit area while to support itself as a sound-proof wall, it is necessary that the flexural stiffness per unit width is $0.1\times10^7$ kg·mm or more, and it is necessary to increase the thickness of the FRP. However, the method for simply thickening the FRP is not a preferred design from the viewpoint of cost and lightening, and it is preferred to form a sandwich structural body or a structural body having a stiffener on the back surface as a basic structure of a sound-proof wall. By this, it becomes possible to obtain a light sound-proof wall panel while ensuring a necessary stiffness. In order to obtain such lightness and necessary mechanical properties, the ratio of the total thickness of a panel T to a thickness of each FRP skin member t1 is preferably within the range of 5:1 to 50:1.

Next, preferred examples of the above-described FRP sound-proof wall panel and tRP sound-proof wall will be explained in more detail referring to the drawings.

FIG. 1 is a partially cut-away perspective view of an FRP sound-proof wall. In FIG. 1, a sound insulation panel (1) is constructed from a core (3) and skin members made of fRP (2) positioned on both sides of the core (3).

In this structure, skin members (2) are made of an FRP which contains reinforcing fibers at a volume content Vf of 15 to 60%, and they are inevitable members in order to ensure strength and stiffness for maintaining a shape as a panel structural body and for resistance against a required load (for example, a wind pressure, a collision of a small flew material, etc.). Preferably, if the volume content Vf is within a range of 30 to 50%, it is possible to prevent deterioration of the matrix resin more properly while keeping the necessary mechanical properties (strength and stiffness). Further, it is preferred that a layer comprising a CFRP (carbon fiber reinforced plastic) is contained at 5% or more in thickness ratio at least relative to the skin members (2). Preferably, it is in the range of 5 to 20%. An appropriate design of the kind and amount of the reinforcing fibers and the kind of the matrix resin provides an advantage to increase the flexural stiffness per unit width of the panel as well as to increase the natural frequency of the panel.

Various materials can be used as the material of core (3), and materials such a inorganic and organic materials, dried sludge, burned ash, etc. can be used. For example, As the inorganic materials, there are metal powder such as aluminum or copper, a siliceous material such as a quartzite or a diatom earth, an aluminate material such as an alumina, a mica or a clay, a calcareous material such as calcium carbonate or a gypsum, a carbide such as graphite or carbon black, concrete (cement), mortar, etc. In particular, it is preferred to mix ferrite particles in concrete (cement) because a function as a wave absorber panel is added. Further, as the organic materials, there are a linter, a linen, a wood (powder) or sea weed powder which is vegetative or animal, and a synthetic resin such as polyamide, viscose, acetate, etc. Further, although a part of dried sludge or burned ash is recycled by burying it or utilizing it as a charging a meterial for a brick and the like, because the handling is troublesome, most of them are conveyed to a disposition place and served to a declamation. Although the treatment of them is expensive, they are extremely inexpensive as a raw material. A damping material may be used for core (3), and as such a damping material, there are a viscoelastic material (for example, butyl rubber, neoprene rubber, urethane rubber, etc.) or a resin or liquid containing powder thereof, a soft vinyl chloride resin, EVA, asphalt, etc. Of course, a resin added with the aforementioned stratified compound, acicular compound, or particulate or plate-like compound, etc. can be used as a charging agent. The panel having this structure is good in vibration damping property, and it is suitable particularly for a place violently vibrated.

Further, as the formation of core (3), there are a solid or powder whose raw material is the above-described inorganic material or organic material, a foamed material whose raw material is an urethane, styrene, or phenol resin and the like, and an aqueous solution or gel liquid of water, polyvinyl alcohol, ethylene glycol, silicone, etc., and a material prepared by solidifying a powder material with a resin may be employed. Although the formation of core (3) is not particularly restricted, it is preferred to use a foamed material having a small specific gravity, a resin blended with shirasu balloons or glass balloons, a balsa wood, etc., because a light sound insulation panel can be obtained. In any case, it is preferred to select the material appropriately in consideration of the cost, weight, property and handling property of the panel. Of course, a combination thereof may be employed.

Figure 15:
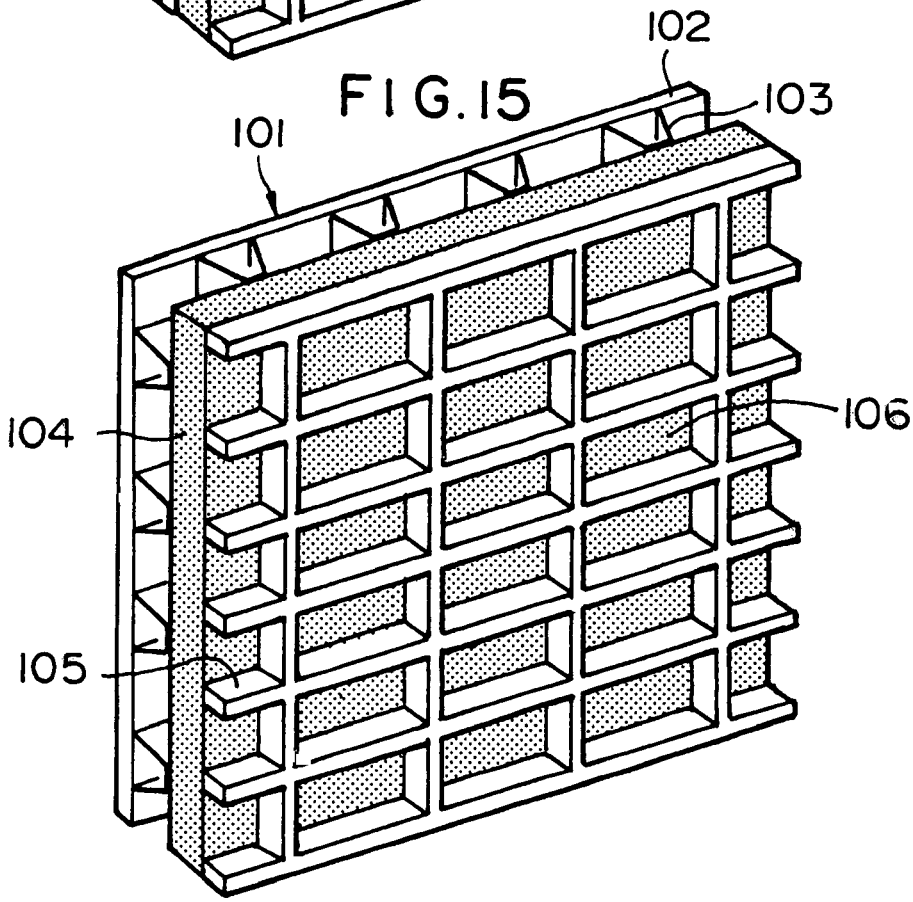
FIG. 15 is a perspective view of another FRP sound-proof wall.

The sound insulation panel (1) may have a sandwich structure as shown in FIG. 1 or a stiffener structure as shown in FIG. 15 described later wherein an FRP reinforcing material is substantially integrated on one surface or both surfaces of an FRP single plate in its lengthwise and crosswise directions or either direction. Although the formation is not limited to these formations, the flexural stiffness per unit width of panel is preferably in a range of (0.1 to 10)×$10^7$ kg·mm. The reason is, for example, in that such a stiffness is necessary in order to ensure a strength and a stiffness against a load such as a wind pressure when the sound insulation is disposed between support poles set at a predetermined interval. Namely, if the flexural stiffness is less than this range, the vibration becomes great by fluttering, not only the panel may become a vibration generation source but also the panel is likely to generate a resonance, and it becomes difficult also to ensure the necessary strength. On the other hand, if flexural stiffness is more than this range, the unit weight of the panel increases, it may become necessary to sue a heavy machine at the time of construction, and the handling property thereof maybe damaged.

The reason why the ratio of the total thickness of the panel T to a thickness of each skin member t1 is within the range of 5:1 to 50:1, is in that, if the thickness t1 of skin member (2*a*, 2*b*) is greater than this range, the lightness may be damaged, and on the contrary, if smaller than this range, the strength may not be exhibited sufficiently. Namely, when the compression strength and the shear stiffness are great such as a case where the above-mentioned core (3) is made of a solid material, a low-degree foamed material, etc., even if the thickness is mall, the panel can resist as a structural body against the above-described load, but in a case where the core (3) is made of powder or liquid, namely, in a case where enough compression strength and shear stiffness cannot be expected, it is necessary to realize a structural body capable of resisting the above-described load only by the FRP portion. Therefore, it is preferred to design the thickness of the skin member depending on the required mechanical properties such as strength and stiffness.

Further, the total thickness of the panel has a relationship with a sound insulation property which is in close relation with mass law, and when the density of the whole panel is small, the panel requires a large thickness, and when the specific gravity of a core is great, because the panel itself becomes heavy, the panel may be formed at a small thickness as a whole. In any case, it is preferred to design the panel in consideration of frequency band of noise, level of transmission loss and cost.

Furthermore, in order to obtain a sound-proof wall panel which can improve the mechanical properties such as strength and stiffness, the lightness and the sound insulation property more than those of the above-described panel, it has been found that the weight per unit area of panel is necessary to be within a range of 10 to 60 kg/$m^2$. This weight can be adjusted by appropriately selecting the thickness of the skin member and the kind and density of the core. If the weight per unit area is smaller than 10 kg/$m^2$ the above-described sound insulation property due to mass law is remarkably damaged, and if the weight is greater than 60 kg/$m^2$, although the sound insulation effect can be improved, it becomes heavy and the handling property deteriorates.

Figure 2:
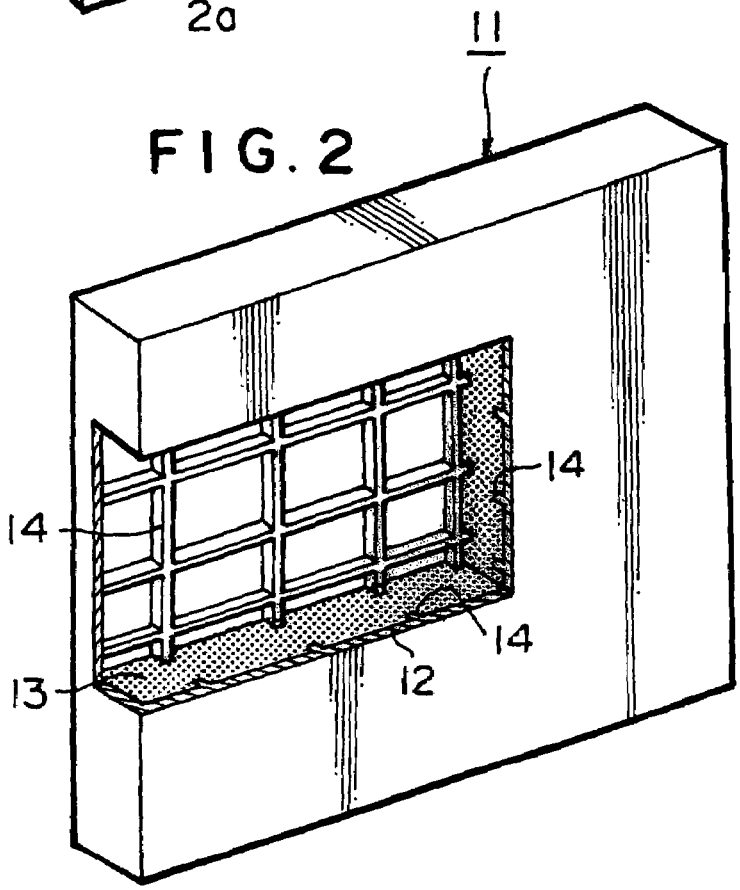
FIG. 2 is a partially cut-away perspective view of another FRP sound-proof wall.
Figure 3:
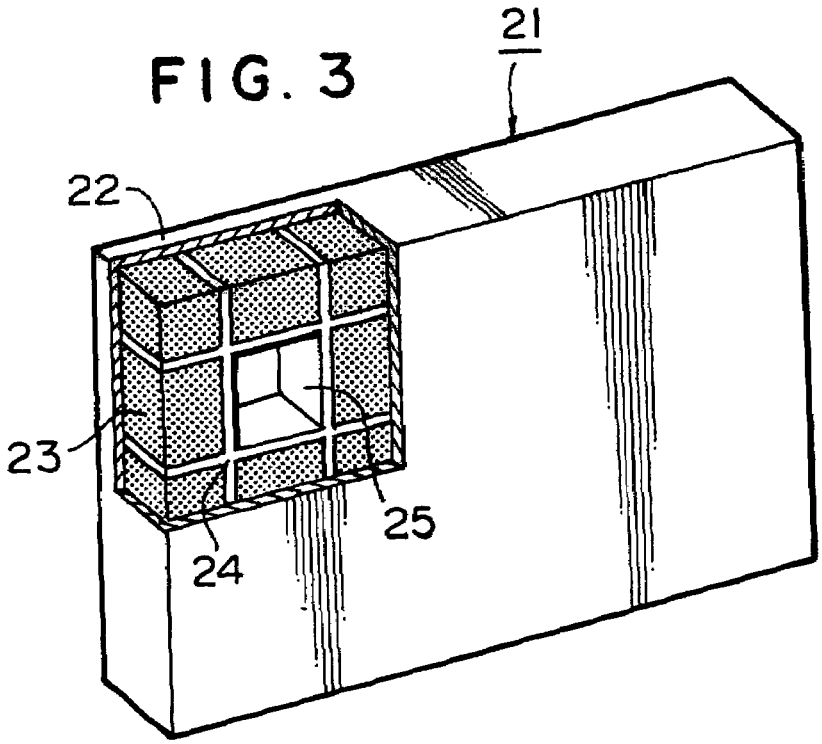
FIG. 3 is a partially cut-away perspective view of still another FRP sound-proof wall.

FIGS. 2 and 3 show sound insulation panels (11, 21) different from that shown in FIG. 1. FIG. 2 shows a structure wherein reinforcing ribs (14) are provided on the inner walls of FRP skin members (12) forming a sound insulation panel (11), and core (13) is disposed inside of the panel. Since the strength and stiffness of a sound insulation panel are flexural properties of a structural body, they are greatly influenced not only by the tensile/compression properties of skin members (12) but also by shear property of core (13). Therefore, in a case where a material attaching importance to lightness is selected as the material of core (13), the strength and stiffness may decrease. In order to prevent this, it is preferred to provide FRP reinforcing ribs (14) in core (13) of sound insulation panel (11). FIG. 3 shows a structure wherein reinforcing rib (24) is provided so as t connect FRP skin member (230 confronting each other and forming sound insulation panel (21), and the panel ahs core (23) therein. In the structure shown in FIG. 3, a part of portions surrounded by reinforcing rib (24) may be a hollow portion (25) in order to further lighten the panel.

In such a structure, the interval of reinforcing ribs (14) provided in the vertical and horizontal directions or one of the directions is preferably within a range of 10-500 mm. The reason is in that, if within this range, small beams are not necessary between the support poles and necessary strength and stiffness can be ensured only by the panel. Where, reinforcing ribs (14, 24) can be extended in both the vertical and horizontal directions or one of the directions. The position and the number of the ribs may be appropriately considered depending upon the strength and stiffness required in accordance with the load applied to a portion between support poles and the panel. The interval of reinforcing ribs (14, 24) is preferably within a range of 25 to 450 mm. If within this range, the thickness of skin members (12, 22) can be smallened, they can be further lightened, and a necessary plane stiffness can be ensured. Where, in a case where core (13, 23) is made of liquid material or powder material, such a structure having reinforcing ribs (14, 24) is preferred, but in a case where the core is made of a material solidifying powder material with a resin, a foamed material, a wood, cement or mortar, because the material itself has a necessary compression strength and shear stiffness required for a core, the reinforcing ribs are not always required, and therefore, it is preferred to design the structure depending on the formation of the core (13, 23). By providing reinforcing ribs (14, 24), the strength and stiffness of sound insulation panel (11, 21) are not influenced by the shear property of core (13, 23), and as a result, there is an advantage capable of freely selecting the material of the core (13, 23) as aforementioned.

Figure 4:
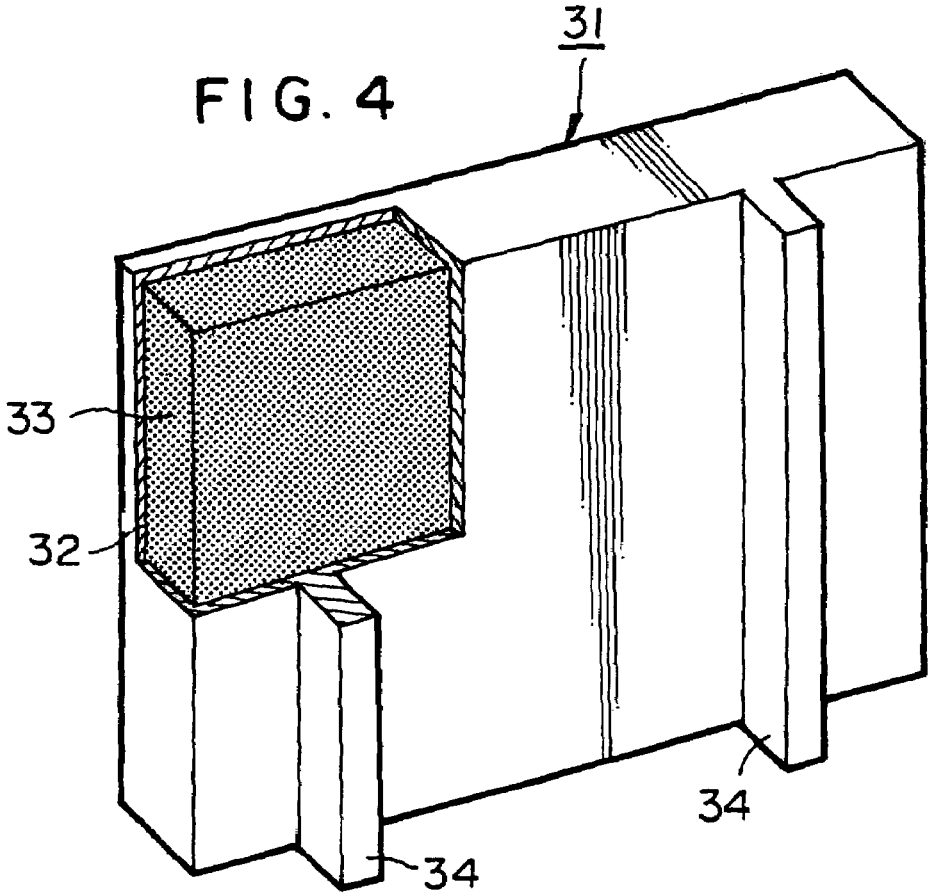
FIG. 4 is a partially cut-away perspective view of a further FRP sound-proof wall.

FIG. 4 shows an FRP sound-proof wall and shows a ease where sound insulation panel (31) has stiffeners outside of it. FIG. 4 shows an example of a structure in which a substantially integrated stiffeners (34) are provided outside of sound insulation panel (31) formed by FRP skin member (32) and core (33). In this structure, stiffeners (34) exhibit an effect similar to that by the aforementioned reinforcing ribs, the stiffness as whole panel can be increased, the thickness of the whole panel can be decreased, and therefore, the panel can be further lightened.

Figure 5:
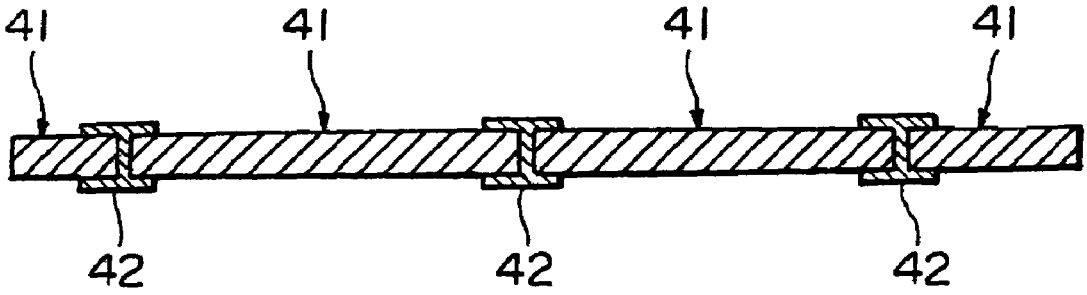
FIG. 5 is a sectional view of yet another FRP sound-proof wall.

FIGS. 5, 6, 7 and 8 show examples of an attachment portion and an attachment structure of an FRP sound-proof wall. FIG. 5 shows a structure in which panels are connected to each other and integrated with each other via a support pole disposed therebetween, and shows structure wherein FRP sound insulation panels (41) are fitted into or inserted into support pole (42) made of a material of metal, an FRP, etc. According to this method, there is an advantage that the panels can be disposed in a limited space and a complicated attachment structure is not required. Further, since the portions of support pole (42) disposed on both surfaces of sound insulation panels (41) are connected to each other to be integrated, the support pole (42) can efficiently fix and support the sound insulation panels (41) even if the support pole (42) is small-sized.

Figure 6:
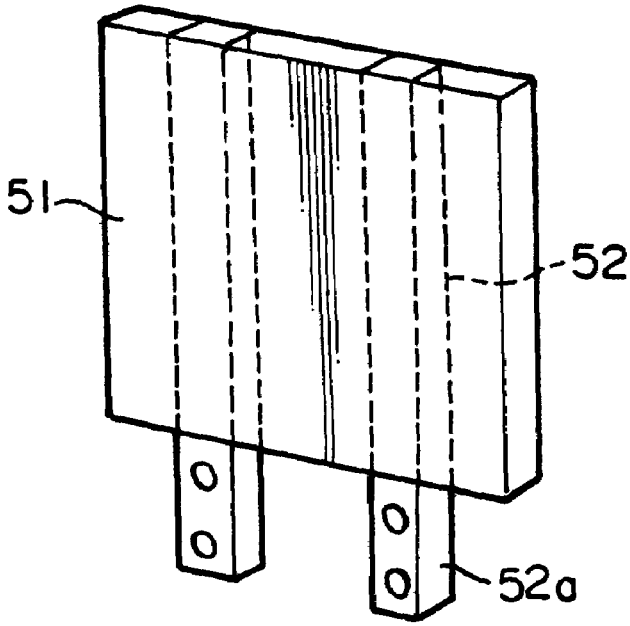
FIG. 6 is a perspective view of still a further FRP sound-proof wall.
Figure 7:
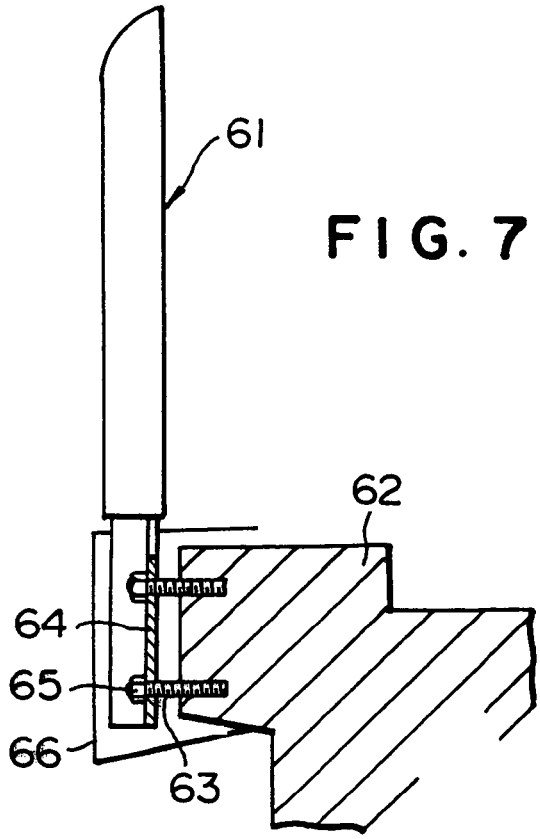

FIGS. 6 and 7 show FRP sound-proof walls. In the structure shown in FIG. 6, poles (52) are provided integrally with sound insulation panel (51) which is formed in a sandwich structure comprising a core and FRP skin members positioned on both surfaces of the core similarly to that sown in FIG. 1. Poles (52) extend down to a position below sound insulation panel (51), and these extending portions are formed as attachment portions (52*a*) to be attached to a construction body. FIG. 7 shows and example of an attachment structure wherein FRP sound-proof wall (61) having a structure similar to that shown in FIG. 6 is attached to construction body (62) such as a high-level bridge, and for example, the wall (61) is fixed to the construction body (62) via chemical anchors (63), a metal plate (64) functioning also as a support pole, and nuts (65). Further, in the structure shown in FIG. 7, the attachment portion is covered with a cover (66). Partially flaking of a concrete construction and dropping of small concrete pieces may occur not only on a portion of a sound-proof wall but also on a construction body itself It is not easy to exchange the construction body differently from the sound-proof wall. However, because such flaking and dropping do not influence the strength and durability of the construction body itself, only dropping to a ground may be prevented. In the structure shown in FIG. 7, in order to prevent small concrete pieces flaked from construction body (62) from being dropped to a ground, cover (66) is formed to be able to be attached/detached and to be easily inspected as to whether flaking of concrete occurs, and as needed, repairing may be easily carried out. Although the material of the cover is not particularly limited, it is preferably made of the same FRP as that of the sound-proof wall, and by this, can be realized a cover light and easy in attachment/detachment and excellent in surface design.

Where, as shown in FIG. 7, it is possible to make pole body (64) from a metal, and the advantage by making the pole body (64) from a metal is in that, since the metal body is generally great in strength as compared with an FRP body even if the shape is same, as shown in the figure, a shape design good in space efficiency, which has no projection such as an attachment portion on the back of the sound-proof wall, can be easily carried out. However, because the strength per unit weight is generally smaller than that in an FRP body, the weight increases. Therefore, as shown in FIG. 6, FRP pole (52) may be employed.

Figure 8:
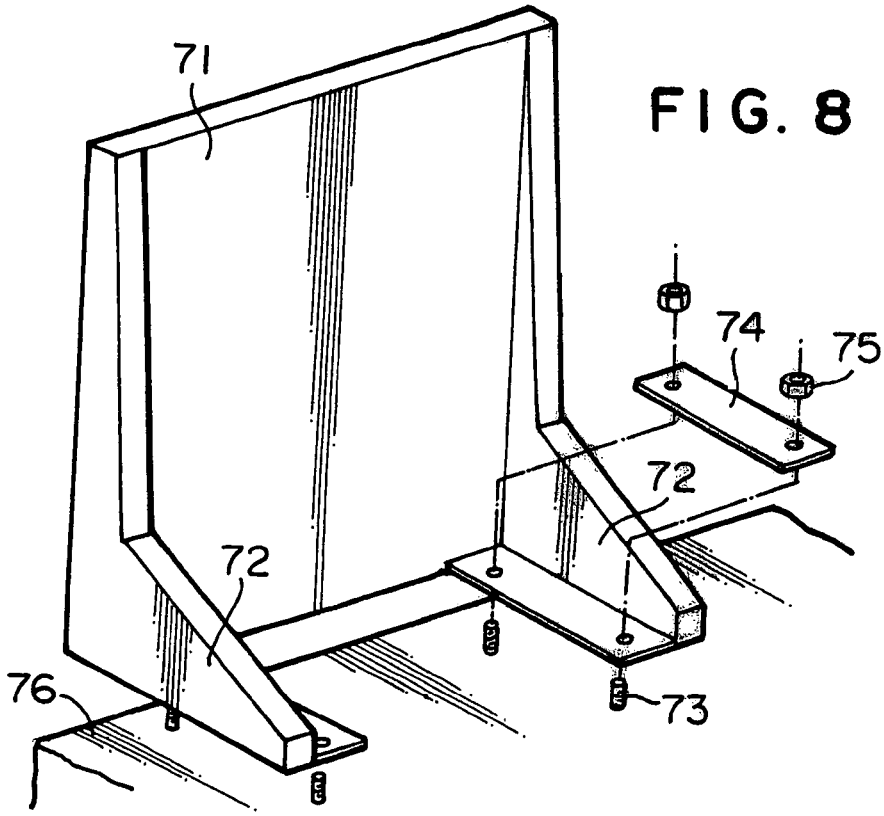
FIG. 8 is a perspective view of an FRP sound-proof wall and its attachment structure portion.

FIG. 8 shows an FRP sound-proof wall A structure is employed wherein attachment portions (72) are provided on a lower portion of sound insulation panel (71) and substantially integrated therewith. Each attachment portion (72) is formed in a triangle shape, and fixed to construction body (76), for example, via chemical anchors (73), a metal plate (74) and nuts (75). However, since it may be fixed to a construction body having a concrete surface, a metal surface, etc. via appropriate fasteners such as bolts and nuts, the fixing means, shape, material, dimension, etc. thereof are not limited. This structure is suitable for application to, for example, a case where there is a restriction in construction and it is impossible to project parts to an outer side, such as a case of a high-level bridge. Further, as the method for attaching a sound-proof wall panel to a construction body, except the attachment method in the above-described structure by fasteners, for example, a method for bonding an attachment portion to a construction body using a resin-system adhesive, or a method for burying an attachment portion into a construction body by placing of mortar, can also be employed. The method is not always limited to this embodiment, and it is preferred to appropriately select the attachment method depending upon circumstances and place for the attachment.

Figure 9:
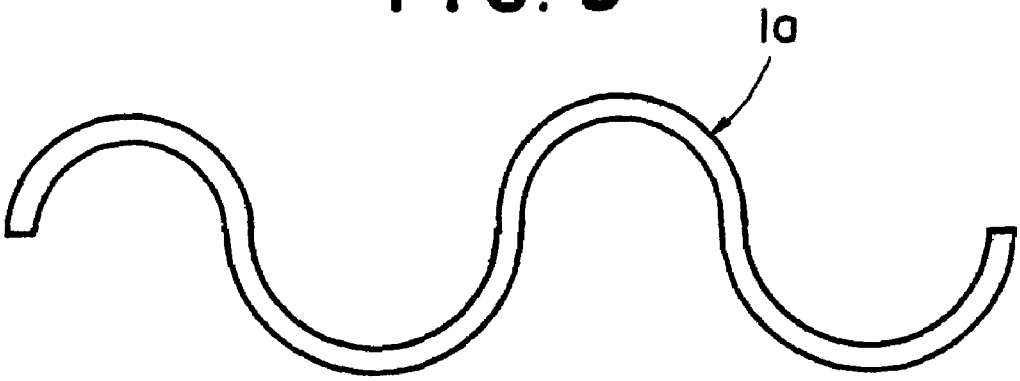
FIG. 9 is a schematic sectional view of an FRP sound-proof wall.
Figure 10:
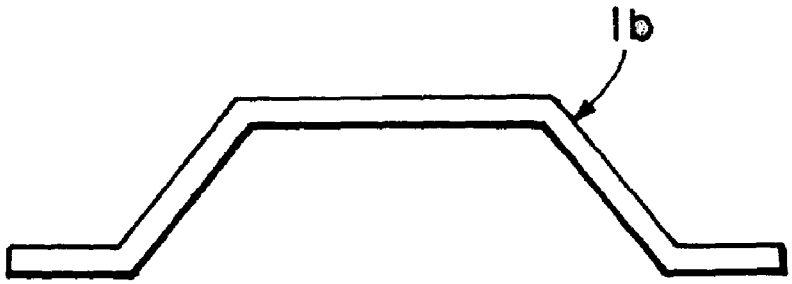
FIG. 10 is a schematic sectional view of another FRP sound-proof wall.
Figure 11:
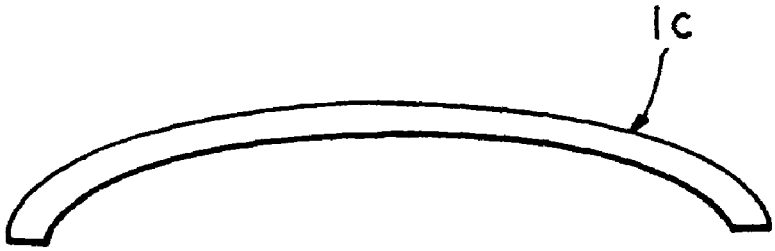
FIG. 11 is a schematic sectional view of yet another FRP sound-proof wall.

FIGS. 9, 10 and 11 show that the sectional shape of a sound insulation panel in the FRP sound-proof wall can employ various shapes except the flat-plate shape shown in FIG. 1, and these shown sectional shapes can be applied for any of the cross-sectional shape and the vertical sectional shape of a panel. FIG. 9 shows a sound insulation panel (1*a*) having a wave-type sectional shape, FIG. 10 shows a sound insulation panel (1*b*) having a hat-type sectional shape, and FIG. 11 shows a sound insulation panel (1*c*) having an arc-type sectional shape. The sectional shape of the panel may be another shape, and it is not particularly limited. It is preferred to select the shape in consideration of stiffness, appearance, design, etc. as a structural body.

Figure 12:
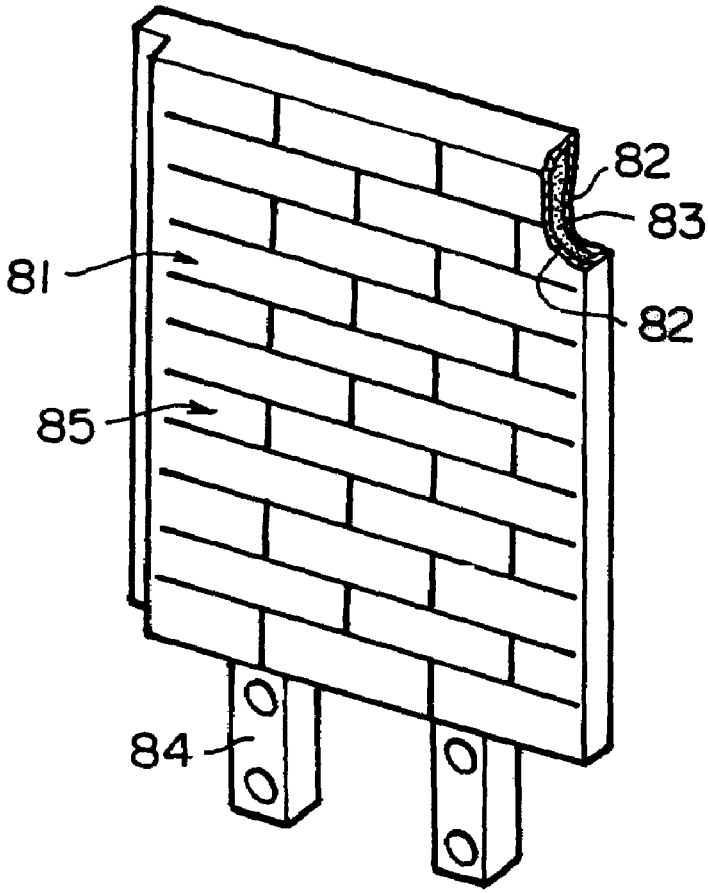
FIG. 12 is a partially cut-away perspective view of an FRP sound-proof wall.
Figure 13:
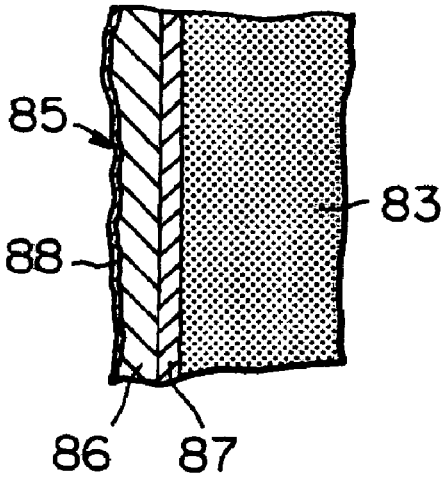
FIG. 13 is an enlarged partial sectional view of the FRP sound-proof wall shown in FIG. 12.

FIG. 12 shows an example wherein the surface of a sound insulation panel (81) is formed as a rough surface having a random irregularity, and FIG. 13 is an enlarged view of the rough surface portion.

The sound-proof wall in the figures comprises a sound insulation panel (81) constructed from a core (83) and FRP skin members (82) positioned on both surfaces of the core (83), and support poles (84) forming attachment portions thereof, and the surface of at least outer-side skin member (82) of the sound insulation panel (81) or a layer added to the outer side of the outer-side skin member (82) is formed as a rough surface (85). Rough surface (85) is formed as a convex/concave surface in which convex portions and concave portions are randomly disposed, and the mean value of the difference between the heights of the convex portions and concave portions is not less than 0.5 mm. Further, the FRP skin member forming rough surface (85), for example as shown in FIG. 13, is formed as a structure which has two layers of a layer (86) for the purpose of at least forming the rough surface (85) and a layer (87) for the purpose of obtaining a strength and a stiffness, and on the outer side of the layer (86) (as an outermost layer), further has a colored layer (88) which is provided for the purpose of improving the appearance (design) and which also has a function of preventing deterioration of resin due to ultraviolet rays. By such a separation into the respective layers, it becomes possible to prevent the orientation of reinforcing fibers for obtaining a strength and a stiffness from being locally bent by the influence due to the irregularity of the surface and to prevent reduction of strength. Further, because the layer (86) does not require a strength, it may be formed, for example, by a layer containing a mat of reinforcing fibers, which can easily form the rough surface (85). The layer (87) is the same layer as that of the aforementioned skin member (2), and it is formed by a reinforcing fiber substrate such as a unidirectional substrate or a woven fabric substrate in order to obtain a strength and a stiffness. The colored layer (88) is formed from, for example, a gel coated layer having two or more colors or a resin containing a pigment.

In order to form the convex/concave surface, although either a method for placing an elastic material such as a rubber in a mold and transferring the pattern of the material or a method for using a mold preformed with a convex/concave pattern on the molding surface of the mold may be employed, the method using an elastic material has an advantage capable of forming convex/concave surfaces with various patterns only by changing the elastic material. Further, by forming rough surface (85) on the outer surface, even if the surface is exposed to the direct rays of the sun, it is possible to prevent a dazzling feeling from being given to a passer-by or a resident nearby by reflecting the rays. Further, by coating the surface with the colored layer, not only the design of the appearance can be improved but also the deterioration of the FRP portion due to ultraviolet rays can be minimized, and therefore, the panel becomes to be suitable for use outside.

Figure 14:
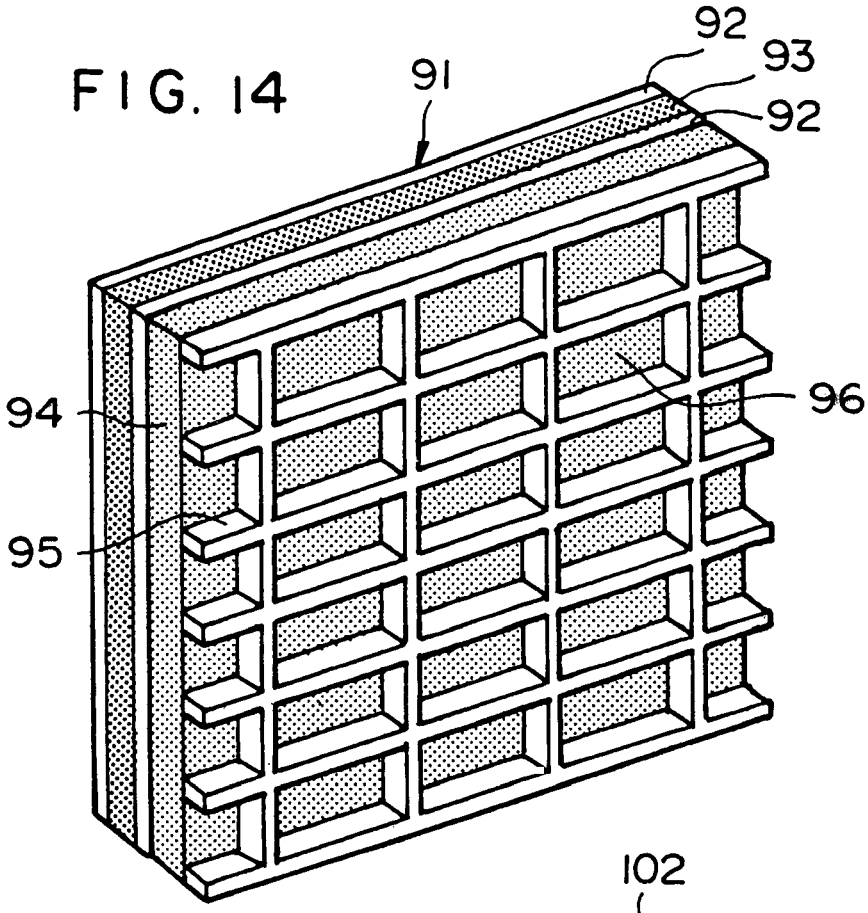
FIG. 14 is a perspective view of an FRP sound-proof wall

FIG. 14 shows an FRP sound-proof wall and FIG. 15 shows an FRP sound-proof wall according to an structure different from the structure shown in FIG. 14.

In the structure shown in FIG. 14, sound insulation panel (91) is formed as a sandwich structure comprising a core (93) and FRP skin members (92) disposed on both surfaces of the core, and formed in a structure wherein a sound absorbing body (94) is provided on both surfaces or one surface of the sound insulation panel (91) and a perforated panel (95) covering the sound absorbing body (94) is provided. In the structure shown in FIG. 15, sound insulation panel (101) is formed as a stiffener structure in which an FRP reinforcing member (103) is substantially integrated with an FRP single plate (102) on one surface of the FRP single plate (102) in the lengthwise and crosswise directions or either direction, and formed in a structure wherein a sound absorbing body (104) is provided on both surfaces or one surface of the sound insulation panel (101) and a perforated panel (105) covering the sound absorbing body (104) is provided. As aforementioned, the sound transmission loss, which is an index of the sound insulation property, basically depends on mass law, and the greater the mass is, the greater the loss becomes. However, in a case where a better sound insulation property as a sound insulation panel is required such as a case where there is only a small space for installation, housing is closer, or there is a restriction in weight as a sound-proof wall, there is a limit in sound-proof property in a structure in which the sound-proof wall is formed only from the above-mentioned sound insulation panel structural body. Accordingly, by using together a sound-proof wall comprising a sound insulation panel and a sound absorbing body, it becomes possible that a sound having entered from the direction of the perforated panel is absorbed, the level of the sound pressure is decreased, the sound energy is further decreased by a vibration system based on the mass law in the portion of the sound insulation panel provided as an outer layer, and the sound-proof effect can be increased.

The sound absorbing property of a sound absorbing material used in the above-described sound absorbing body changes generally depending on the incident angle of the sound, and the sound absorbing rate ($\alpha$) of the sound absorbing material is defined as a ratio ($\alpha=(It+Ia)/Ii$) of the sum of a transmission energy (It) and an energy (Ia) absorbed in the interior of the material relative to an energy (Ii) of an incident sound to the surface of the material. The sound absorbing material is classified by its structure (thickness, porosity, etc.) and appearance, and the material comprises a porous material (a rock wool or an asbestos comprising cotton-like mineral fibers, a glass wool comprising glass fibers, a felt material punching these materials, a sponge comprising a soft urethane foam, etc.), a plate-like material (a plywood, an asbestos cement, a gypsum board, etc.), or a perforated material thereof, and the porous material has become a main material used as a sound absorbing material because it is a material having a great sound absorbing rate over a broad frequency range. In this connection, when a glass wool is exemplified and the change of its sound absorbing rate is determined, the sound absorbing rate is in a range of 50 to 70% at a thickness of 13 mm in the audible frequency range of 125 Hz to 4 kHz, and the sound absorbing rate is in a range of 30 to 90% at a thickness of 75 mm. The sound absorbing rate of a plate-like material is about 50% irrelatively to its thickness. Namely, the sound absorbing body aims to reduce the sound reflected from the material, the above-described porous material is suitable therefor such as a wool-like material, a foam, a felt, a nonwoven fabric, etc., and such a material can exhibit a great sound absorbing effect in a broad frequency range. Except such a material, perforated gypsum board, etc. may be employed, further, a combination of these materials may be employed, and it is preferred to appropriately select the material depending on the frequency to be absorbed. A preferable thickness is in a range of 11 to 80 mm.

Further, as aforementioned, the sound absorbing material functions to damp a sound pressure, the material solely is low in property for insulating a sound, and by using it together with a sound insulating member, the sound insulation property can be improved, and therefore, usually it is used at a condition being bonded to a back surface of an inorganic board or a concrete wall. Therefore, as FRP sound insulation panel (91, 101), it is preferred that perforated panel (95, 105), sound absorbing body (94, 104) and sound insulation panel (91, 101) are disposed in this order as viewed from the side of a noise source. In a case where there are noise sources on both sides, the preferable disposition, of course, should be in an order of a perforated panel, a sound absorbing body, a sound insulation panel, a sound absorbing body and a perforated panel.

Where, the FRP perforated panel functions to prevent scattering of the sound absorbing material of the sound absorbing body comprising the porous material described below, and the thickness thereof may be in a range of 1 to 3 mm. The perforated panel is a kind of a cover for damping the incident sound energy at the sound absorbing body without reflecting the sound at the surface of the material by existence of opening portions (96, 106) as shown in FIGS. 14 and 15, and therefore, although a certain degree of strength is required therefor, the opening rate may be in a range of 50 to 90%. Where, the opening rate of a perforated panel is defined as a rate determined by dividing an area of an opening or of a portion cut away in a form of a rectangle with an area without an opening or without a cut-away portion. However, the perforated panel is not always necessary in a case where the sound absorbing body comprises a felt or plate-like material formed at a high density and the sound absorbing body itself can maintain the self shape or has a certain-level high strength.

Although the perforated panel is shown as a lattice-type structural body in FIGS. 14 and 15, a plate having holes may be employed, and the shape and structure may be arbitrarily designed, it is not particularly limited. However, if the opening rate is too small, the reflection of sound increases, and if the opening rate is too large, a necessary strength cannot be ensured, and therefore, this point must be paid attention to. Further, although the material of the perforated panel in this structure is an FRP, it is not particularly limited, and although it may be made of either an FRP or a metal, making from an FRP is preferred from the viewpoint of durability, corrosion resistance and lightness.

The sound-proof wall having two typical structures as described above exhibits the following effects.

According to a first effect, since the sound insulation panel is constructed from FRP skin members and a core, the specific strength is high as compared with that of a concrete or a usual metal such as an iron, providing a necessary strength as a sound-proof wall and great lightening can be both realized, and since the shape can be designed as a shape simple and good in handling property, installation to a high-level place can be easily carried out without using an exclusive construction apparatus such as a heavy machine.

Further, in a case where the sound-proof wall is applied to a high-level place of a railway or a road, because the construction body set at the high-level place can be greatly lightened, the earthquake-proof property of the high-level bridge can be improved similarly to reinforcement of support poles of the high-level bridge. Further, since the FRP can be increased in resistance against moisture and chemicals by appropriately selecting the material of its plastic as compared with a metal such as an iron and an aluminum alloy, a maintenance such as painting for preventing rust is not necessary. However, because against ultraviolet rays the plastic gradually deteriorates and it causes the properties such as strength to gradually decrease, in a case where the condition of use in outside for a long term is employed, it is possible to prevent ultraviolet rays from entering into the interior of the structural body by providing a colored gel coated layer or painting, as aforementioned. Further, because of FRP, there is an advantage that a rough surface can be formed on its surface at the same time as molding, thereby not only avoiding a dazzle accompanying with reflected rays but also easily realizing a surface having an extremely high-grade design, which has not been realized in the conventional concrete or metal products, by utilizing a freedom of FRP molding for forming a complicated shape, and obtaining a desirable result in appearance.

According to a second effect, in a case where there is a restriction in attachment space, in a case where there is a restriction in weight of the whole sound-proof wall ascribed to the strength of a construction body, in a case where there is no side way for a high-level bridge and taking measures to the noise is further required because housing is close thereto, or in a case where reduction of great noises due to running of high-speed cars is required, by providing a sound absorbing body on both surfaces or one surface of the sound insulation panel, it becomes possible to increase the sound-proof effect by absorbing and damping the sound energy and reducing the level of the sound pressure by a vibration system due to a spring of an air layer in the porous material of the sound absorbing body against the incident sound and by further reducing the sound energy by a vibration system based on mass law in the sound insulation panel portion provided as an outer layer.

Figure 16:
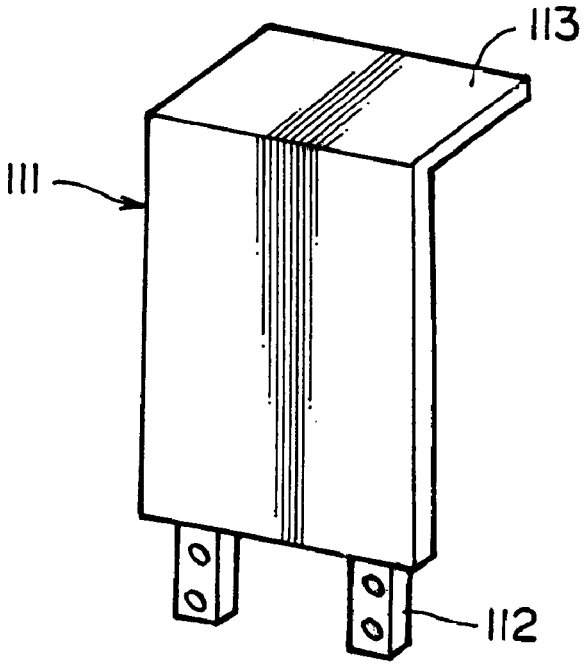
FIG. 16 is a perspective view of a further FRP sound-proof wall.

FIG. 16 shows a sound-proof wall.

In the structure shown in FIG. 16, a folded portion (113) extending toward a direction of a noise source (in this case, toward the inside) is provided on the top of a sound insulation portion (111) provided with support poles (112) having attachment portions to a construction body at the lower portion of the sound insulation portion, and the folded portion (113) is formed integrally with the sound insulation portion (111). Such a shape having a folded portion extended toward the inside exhibits an effect for reducing the sound propagating toward the front side by diffracting the sound by the folded portion (113), and therefore, the sound-proof effect can be further improved.

Figure 17:
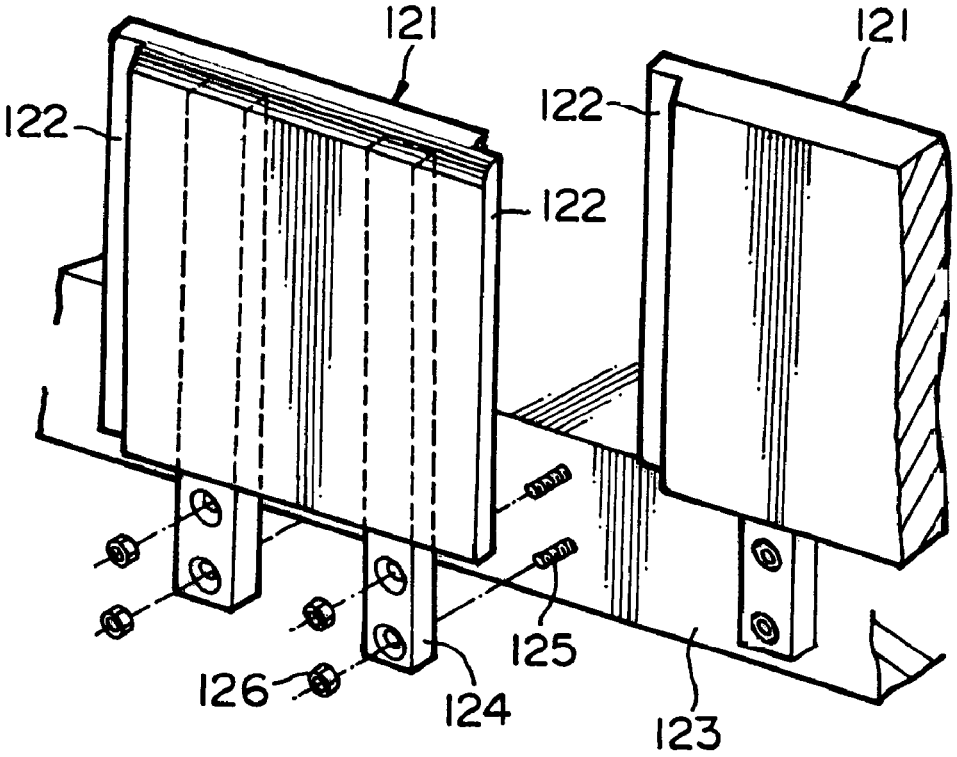
FIG. 17 is a perspective view of FRP sound-proof walls and their attachment structure portions, showing an embodiment of a plurality of FRP sound-proof walls connected to each other.

FIG. 17 shows structure in which a plurality of sound-proof walls are connected.

In the structure shown in FIG. 17, an overlapping portion (122) is provided on a side end portion of each sound insulation panel (121) so that sound insulation panels (121) adjacent to each other are partially overlapped. Support poles (124) each having an attachment portion to construction body (123) are provided on each of a plurality of sound insulation panels (121) connected to each other, and each support pole (124) is fixed to the construction body (123), for example, via chemical anchors (125) and nuts (126). Overlapping portion (122) is formed in a stepped structure having a thickness of half of the thickness of sound insulation panels (121), and a joint portion of sound insulation panels (121) adjacent to each other is formed by overlapping the overlapping portions (122) with each other. A structure may be employed wherein a slight gap is formed between overlapping portions (122) overlapped with each other, and for example, a sealing material such as a sponge and the like or a packing material such as a sealant or another material is disposed between the overlapping portions to improve the sealability. By such a structure, it is possible to improve the appearance of a series of sound-proof walls connected to each other and further increase the sound-proof effect. Although a structure of overlapping portions (122) overlapped with each other is employed in this embodiment, a formation may be employed wherein fitting portions comprising recessed portions or projected portions are provided on the respective end portions of adjacent sound insulation panels. Further, if support poles for attachment (for example, support poles made of an H-section steel) exist at a relatively small interval, the above-described overlapping portions may be omitted. In this case, it is possible to give a function for connection to each other to the flange portion of each H-section steel.

Figure 18:
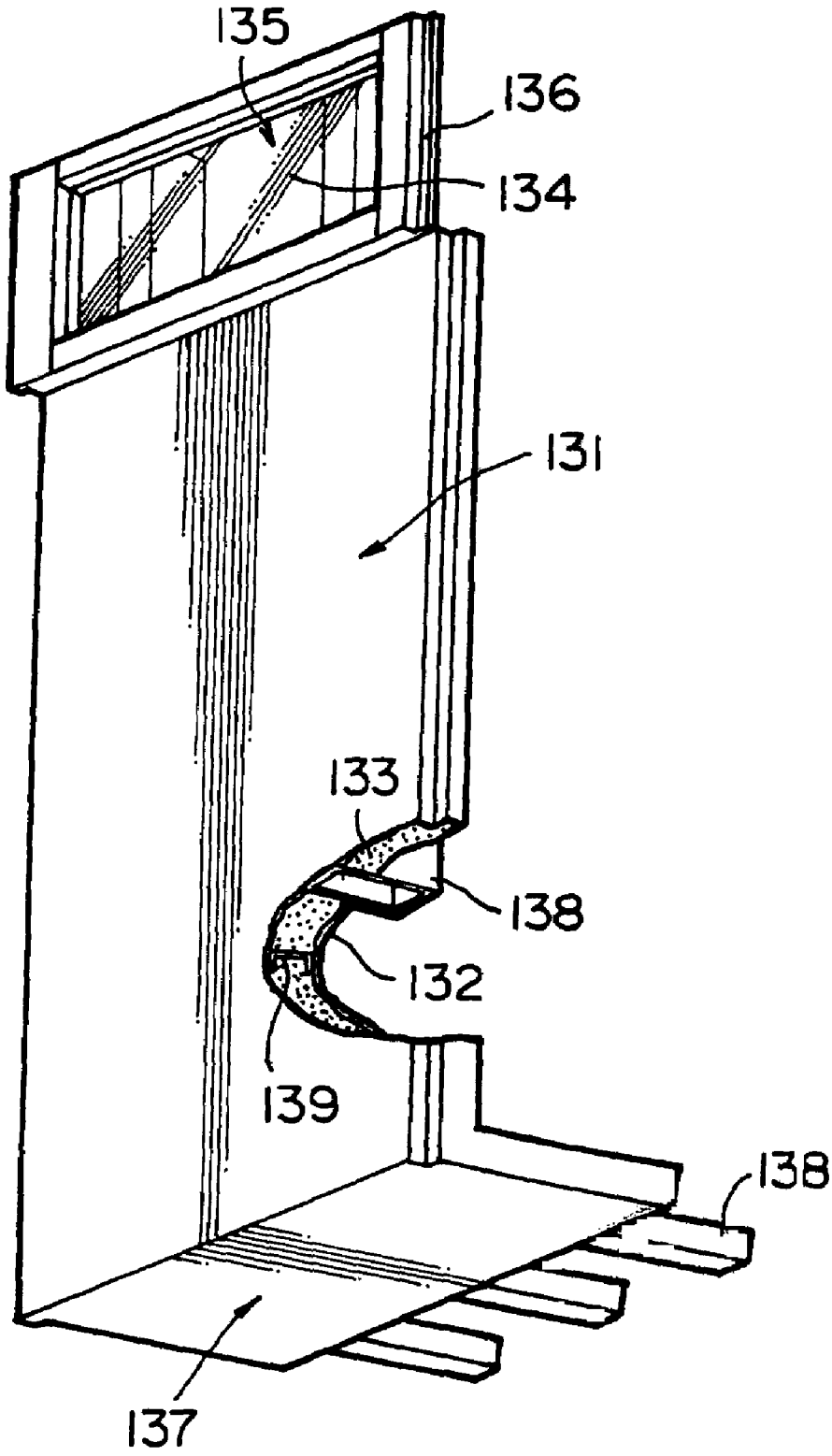
FIG. 18 is a perspective view of an FRP sound-proof wall.

FIG. 18 shows a sound-proof wall.

The sound-proof wall shown in FIG. 18 comprises a sound insulation panel (131) comprising a core (133) and FRP skin members (132) positioned on both sides of the core, and a sound insulation body (135) comprising a light transmitting material (134). A polycarbonate, a reinforced glass, an acrylic, etc. can be used as light transmitting material (134), and among these materials, polycarbonate having a great elongation and capable of being thinned is preferred. The thickness of a plate of polycarbonate is preferably not less than 5 mm from the viewpoint of sound-proof property, and a weather-proof sheet may be bonded to the plate in order to improve the weather-proof property. Sound insulation body (135) is held by, for example, a metal frame (136) made of an aluminum, etc., and an L-shaped attachment portion (137) is formed at the lower portion of sound insulation panel (131). Further, support poles (138) extend over sound insulation panel (131) and sound insulation body (135) to support these portions, and the support poles (138) are formed integrally with the sound insulation panel (131). However, the support poles (138) may be mechanically bonded without integrally forming. Further, support poles (138) also are provided in the L-shaped folded portion at the lower portion of sound insulation panel (131) integrally with the portion, and they form a part of attachment portion (137). In the sound-proof wall having such a structure, by providing a daylighting portion comprising light transmitting material (134), the sound-proof wall can be heightened, the sound insulation property can be improved, and limitation of sunshine to residents in housing and buildings can be avoided without damaging visibility for passengers. The daylighting portion is preferably formed in a structure for providing an opening portion in the sound insulation panel and fitting the above-described light transmitting material into the opening portion because the number of parts can be reduced.

The sound-proof wall is not limited to the structures explained above, and it is preferred that the structure is appropriately selected or combined in consideration of an optimum formation, an attachment method, a design of the surface, etc. depending upon the attachment place, the required attachment method, the sight nearby, the level of noise, etc.

Next, the method for producing a sound-proof wall will be explained.

As the method for producing a sound-proof wall panel; any usual method for molding an FRP such as hand-lay-up method and autoclave method can be employed. Further, the panel can also be formed by cutting members molded by a continuous molding method such as pultrusion method at respective required dimensions, and thereafter bonding and assembling them. However, it is preferred to employ a molding method such as so-called RTM or RIM method in which an integral molding is easily carried out and lightening can be easily achieved by increasing the fiber volume content, or an integral molding method (SCRIMP method) in which a portion to be molded is reduced in pressure and at the same time a distribution material for a resin to be injected is disposed. For example, a method is preferably employed, wherein reinforcing fibers such as a glass fiber woven fabric and a unidirectional woven fabric of carbon fibers are stacked, a hard polyurethane foamed material having a specific gravity of 0.03 to 0.1 or a wooden material having a specific gravity of 0.1 to 1.0 (for example, a balsa material or a furcata material) is placed in a cavity of a mold, the inside of the cavity is vacuumed and a matrix resin such as a flame-proof unsaturated polyester resin is injected and cured.

According to such a molding method, there is an advantage that the fiber volume content can be increased and a molded body having high strength and stiffness can be produced relatively inexpensively. Moreover, it is preferable because it is possible to form the metal or FRP support poles simultaneously with molding of a sound insulation panel as in the present invention.

We found that, to obtain the same level of sound insulation property as that in a conventional concrete sound-proof wall at a constant thickness of a skin member, a thickness of 50 mm or more is required in a case of a core made of a foamed material, a thickness of 35 mm or more is required in a case of a wooden core, and it is possible to give strength and stiffness capable of resisting against a wind pressure of 300 kg/m$^2$ to 400 kg/$^2$ per unit area even in the case of a core made of a foamed material. Further, in the case of a wooden core, it has been found that, particularly because the shear stiffness is high, when the flexural strength of the whole panel is determined, a strength of about three times that of a foamed-material core can be obtained, and it is suitable for a case where a higher load is applied to a panel.

Further, in the above-described molding method, it is easy to integrally form reinforcing ribs. For example, it may be carried out that reinforcing fibers for forming reinforcing ribs are wound around a core in advance, and a resin is impregnated into the wound reinforcing fibers simultaneously with molding of skin members. In such a method, there is an advantage that a stable strength at a boundary between layers higher than that in a case of bonding by adhesion can be obtained. As the method for obtaining a sound insulation panel, except the above-described methods, for example, a method may be employed wherein an SMC substrate is used, after separated two portions of a front portion and a rear portion of a sound insulation panel are molded, the front portion and the rear portion are bonded by an adhesive or by machine bonding to form a hollow panel with a hollow portion therein, and a predetermined core material is charged into the hollow portion, and for example, an inner pressure is applied to a hollow blow-molded body or a balloon to form therein a portion to be formed as a core, and a predetermined core material may be charged into the inside of the molded hollow skin member.

Further, a colored layer provided as an outermost layer for mainly improving the appearance (improving the design) and further having a function for preventing deterioration of a resin due to ultraviolet rays can be formed, for example, by blowing a gel coating material or a pigment-containing resin having two or more colors by an air gun, etc. Because the gel coated layer is formed by blowing a gel coating material onto a mold in advance and forming the layer together with molding skin members, the gel coated layer is substantially integrated and the adhesive property is excellent. At this juncture, by disposing a mat substrate of 200 to 450 g/m$^2$ (for example, chopped strand mat comprising glass fibers) between the reinforcing fiber layer of a skin member comprising a unidirectional substrate or a woven fabric substrate and the gel coated layer, the adhesive property with the skin member can be further increased.

On the other hand, although a surface having an irregularity of 0.5 mm or less can be formed even by blowing a high-viscosity pigment-containing resin having a viscosity of 5 to 25 dPa·s to the surface of a skin member, a sufficient decreasing is required, and because there may be a case where the adhesive property becomes smaller than that in the case of a gel coated layer, it must be carried out with care.

Further, the colored layer accompanying with a mat substrate also can be preformed, and after a sound insulation panel is molded, it can be formed by bonding the preformed layer with an adhesive or at least the same resin as the matrix resin via the mat.

Further, in the colored layer accompanying with a mat substrate, because the layer of the mat substrate does not require a strength and it is a layer for forming a rough surface, in a case where a design surface with an irregular surface of 0.5 mm or more is formed, as described above, a layer functioning to give strength and stiffness and a layer functioning to give a design can be separated into the respective different layers, and therefore, it can be prevented to cause the orientation of reinforcing fibers for obtaining the strength and stiffness to locally bend by the influence due to the irregularity of the surface, and reduction in strength of the panel can be prevented. As the method for forming the irregular surface, although either a method for placing an elastic material such as a rubber in a mold and transferring the pattern of the material, or a method for using a mold in which an irregular pattern is formed in advance on the molding surface of the mold, may be employed, the method using the elastic material is preferred because various patterns can be formed only by exchanging the elastic material. As the method for forming a design surface, for example, a method also can be employed wherein a thermoplastic resin sheet printed in advance is bonded to the surface of a skin member.

Next, the FRP sound-proof wall, having a structure in which a sound absorbing body is provided on each of or one of the surfaces of an FRP sound insulation panel and a perforated panel covering the sound absorbing body is provided, can be obtained by forming the sound insulation panel in advance as described above, and for example, mechanically bonding a glass wool, formed as a porous material and having a predetermined thickness, to the sound insulation panel with the FRP perforated panel by using vises, etc. Although the above-described perforated panel can be obtained by perforating a plate material, which is prepared by stacking mat substrates comprising glass fibers and woven fabric substrates alternately while impregnating a resin and curing the resin, by machining, it also can be obtained by molding while arranging unidirectional fibers along a lattice-type mold, and other methods may be employed to form a target perforated panel.

EXAMPLES

Hereinafter, our walls will be explained based on examples.

Example 1

Woven fabrics of glass fibers with an orientation of 0/90° and unidirectional woven fabrics of carbon fibers were stacked as reinforcing fibers of FRP skin members, multi-axial woven fabrics of glass fibers with an orientation of 0/±45° were disposed for forming reinforcing ribs, and by using a 30 times foamed hard polyurethane foamed body as a core and by impregnating and curing a flame-proof unsaturated polyester resin added with 20 parts of a boromic-group halogenated organic substance (DBDPO) by a vacuum injection and impregnation molding method, an FRP sound-proof wall body as shown in FIG. 8 and having a height of 1525 mm, a width of 990 mm and a total thickness of the sound-proof portion of 56 mm was obtained. At this juncture, the total weight of the structural body (the same body as that of panel 2 of Example 4 described later) was 20.6 kg, and the weight per unit area was 13.6 kg/mm$^2$.

When this molded body was attached to a base frame so that the sound insulation panel (71) was placed horizontally, and a compression load was applied to the sound insulation panel (71) from the upper side in the vertical direction by a large-sized universal tester, the root portion of the attachment portion (72) molded integrally with the sound insulation panel (71) was broken at a load of 20 kN. When this value of the load was divided by the area of the sound-proof portion of the sound insulation panel, the divided value was about 13 kN/m$^2$, and it was understood that a sufficient strength against a load applied by wind was given. When a 200 mm square sample was cut out from the molded body of the sound insulation panel (71) and the sound insulation property against a white noise was determined, the transmission loss was 13 dB. As the result that a similar determination was carried out as to a concrete block having a total thickness of 100 mm, the transmission loss was 22 dB.

Example 2

Employing similar substrate formation and resin, and using a pipe made of SUS 304 (stainless) having a thickness of 2 mm and a rectangular section of 100 mm×50 mm as the support pole having an attachment portion, the pole was extended up to the top of the sound insulation portion and was molded integrally. At this juncture, the fiber direction of carbon fiber 0 degree woven fabric was oriented at 90° relative to the extending direction of the SUS 304 pipe, and in the same direction as the fiber direction, ribs were disposed at four positions at a pitch of 320 mm. Further, overlapping portions as shown in FIG. 17 were formed on both ends. Thus, an FRP sound-proof wall, having a height of the sound insulation panel of 1600 mm and a total width including overlapping portions at both ends of 1040 mm, was obtained. The support pole for attachment was formed in a form shown in FIG. 6 so as to project from the lower end of the sound insulation portion by 400 mm. The total weight of the FRP sound-proof wall obtained was 42 kg, and the weight per unit area of the sound-proof portion was 25.2 kg/m$^2$.

This molded body was attached to a concrete construction body so that the sound insulation panel was placed horizontally, and a compression load was applied to the sound insulation panel from the upper side in the vertical direction by a large-sized universal. When the load was applied up to 5 kN and thereafter the load was removed, no change was appeared in the structural body. Further, when the load was applied up to 7 kN and thereafter the load was removed, a slight plastic deformation was recognized in the SUS 304 pipe forming the attachment portion. However, because the value of the 7 kN load was divided with the area of the sound-proof portion and the resulted value was about 4.4 kN/m$^2$ it was understood that a sufficient strength against a load applied by wind was given. With respect to the transmission loss, because the structure of the sound insulation panel was almost the same as that in Example 1, it was a same-level property.

Example 3

A glass wool material having a thickness of 13 mm was placed as a sound absorbing body on the back surface of a sound insulation panel having the same substrate structure as that described above, and from thereabove, an FRP molded plate having a thickness of 2 mm and rectangular openings each having a size of 95 mm×22.5 mm with a opening rate of 85% was attached to the sound insulation panel body with tapping vises via a spacer having a height of 13 mm. When the transmission loss was determined in the same condition as that described above, an improvement of the sound insulation property by 5 dB could be achieved. The total weight of this panel was 53 kg, and the weight per unit area was 32 kg/m$^2$.

Example 4

Although only the weight and the sound insulation property were investigated in Examples 1 to 3, in order to investigate relationships between the flexural stiffness, the deflection and the strength of a sound insulation panel according to the present invention and the thickness of the panel, panels and single plates having structures shown in FIG. 19 were formed using the substrates shown in Table 1 at the same conditions as those in Example 1 other than the conditions of the thickness of a skin member, the kind of a core, presence of a core and the thickness of the core. Then, the strengths and the amounts of deformation of these samples were determined by carrying out a four-point bending test (load application speed: 5 mm/min.) at a condition where each sample was set at a support span of 40 times the total thickness of the panel or the single plate and the span was divided into three equal parts. Further, when the result of the bending test was investigated, the thickness ratio β, the proof stress ratio η and the deformation degree Δ were defined as follows, respectively, and the result of the test was shown in Table 2.

Thickness ratio $\beta$=total thickness $T$/(2×thickness of skin member $t1$)

Proof stress ratio $\eta$=bending moment at the time of breakage (kg·$m$)/bending moment at the time of a wind load of 300 kg/m$^2$ (2940 N/m$^2$)

Deformation degree $\Delta$=deflection $\delta$ (mm) at a load applied condition of a wind load of 300 kg/m$^2$ (2940 N/m$^2$)/support span L (mm) at the time of the test The weight is related to the transmission loss, the proof stress ratio is related to the strength (=the safety factor), the flexural stiffness and the deformation degree are related to the deflection as a structural body, and especially if the deformation degree is great, the panel itself is fluttered and the panel itself becomes a noise source.

Figure 20:
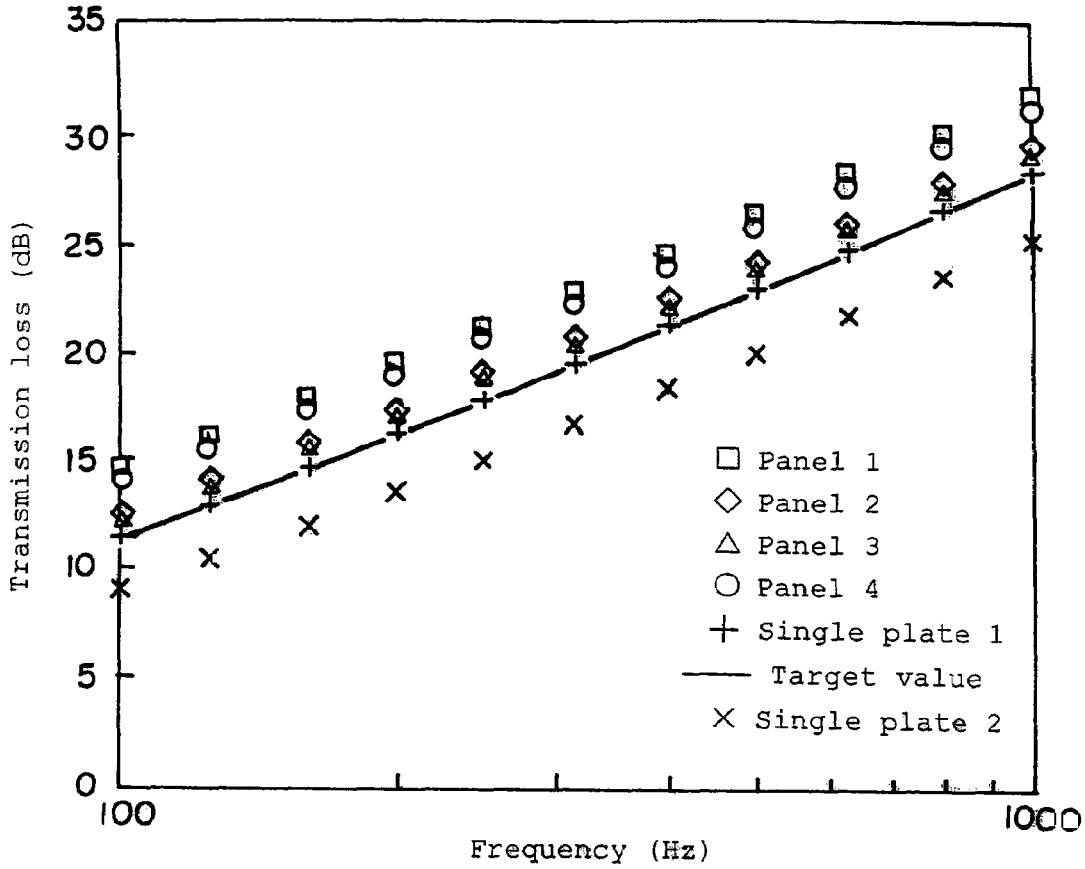
FIG. 20 is a graph showing relationships between frequency bands and transmission losses of respective samples in Example 4 and Comparative Example 3.
Figure 21:
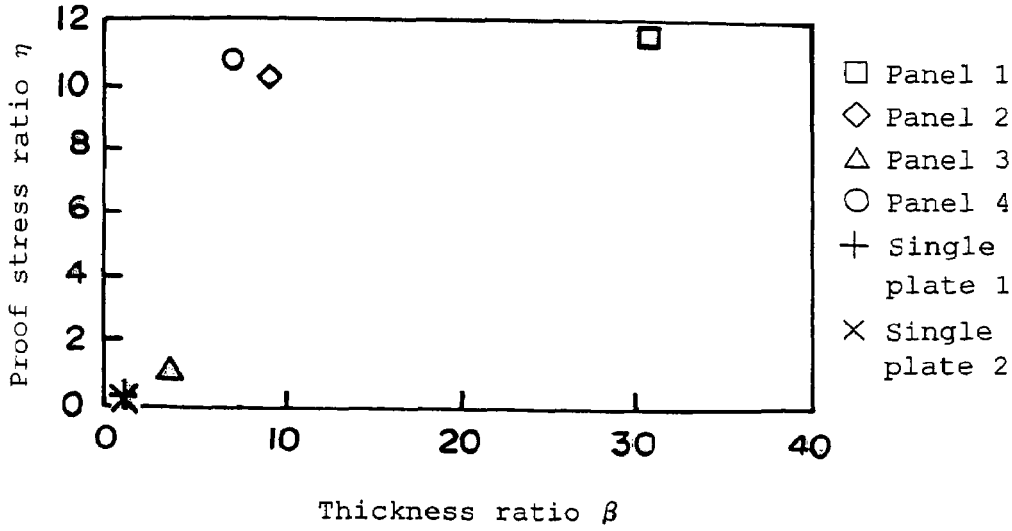
FIG. 21 is a graph showing relationships between thickness ratios and proof stress ratios of respective samples in Example 4 and Comparative Example 3.
Figure 22:
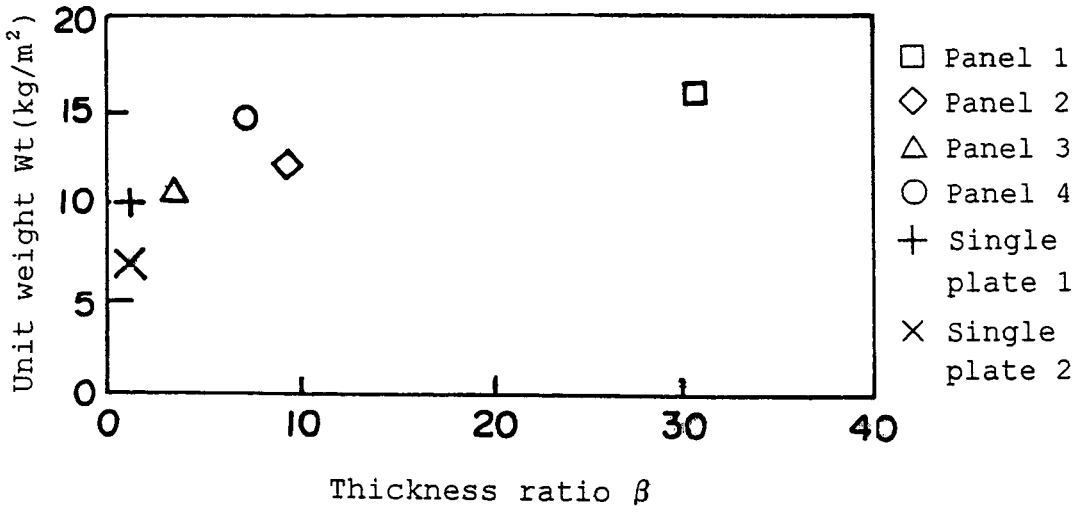
FIG. 22 is a graph showing relationships between thickness ratios and unit weights of respective samples in Example 4 and Comparative Example 3.
Figure 23:
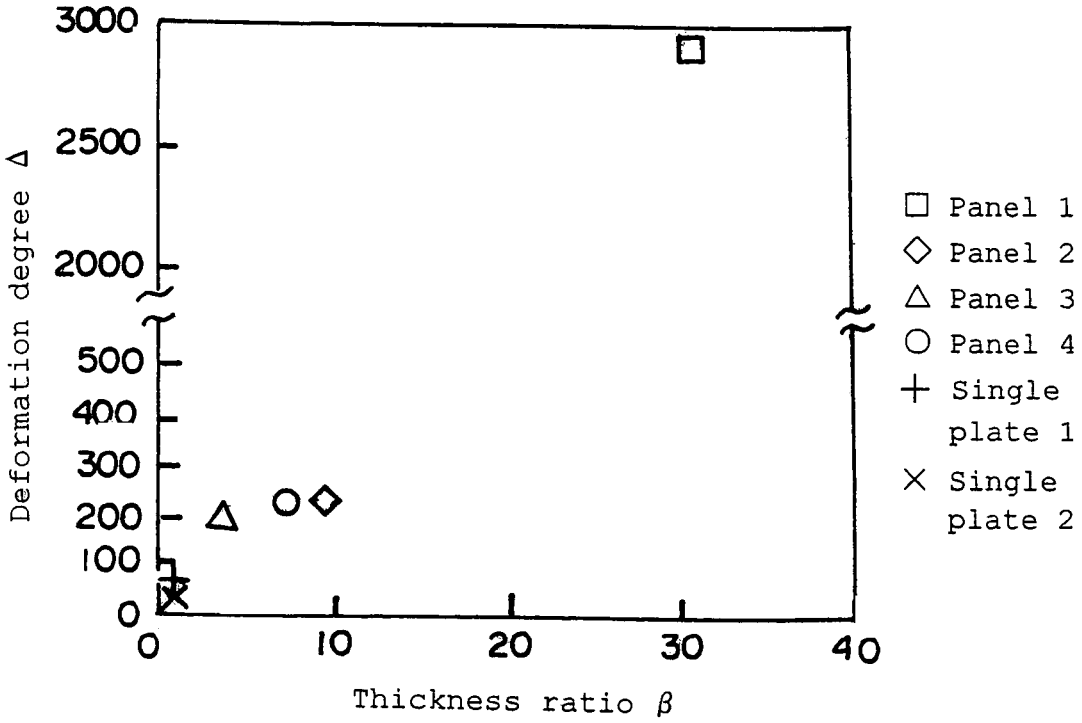
FIG. 23 is a graph showing relationships between thickness ratios and deformation degrees of respective samples in Example 4 and Comparative Example 3.
Figure 24:
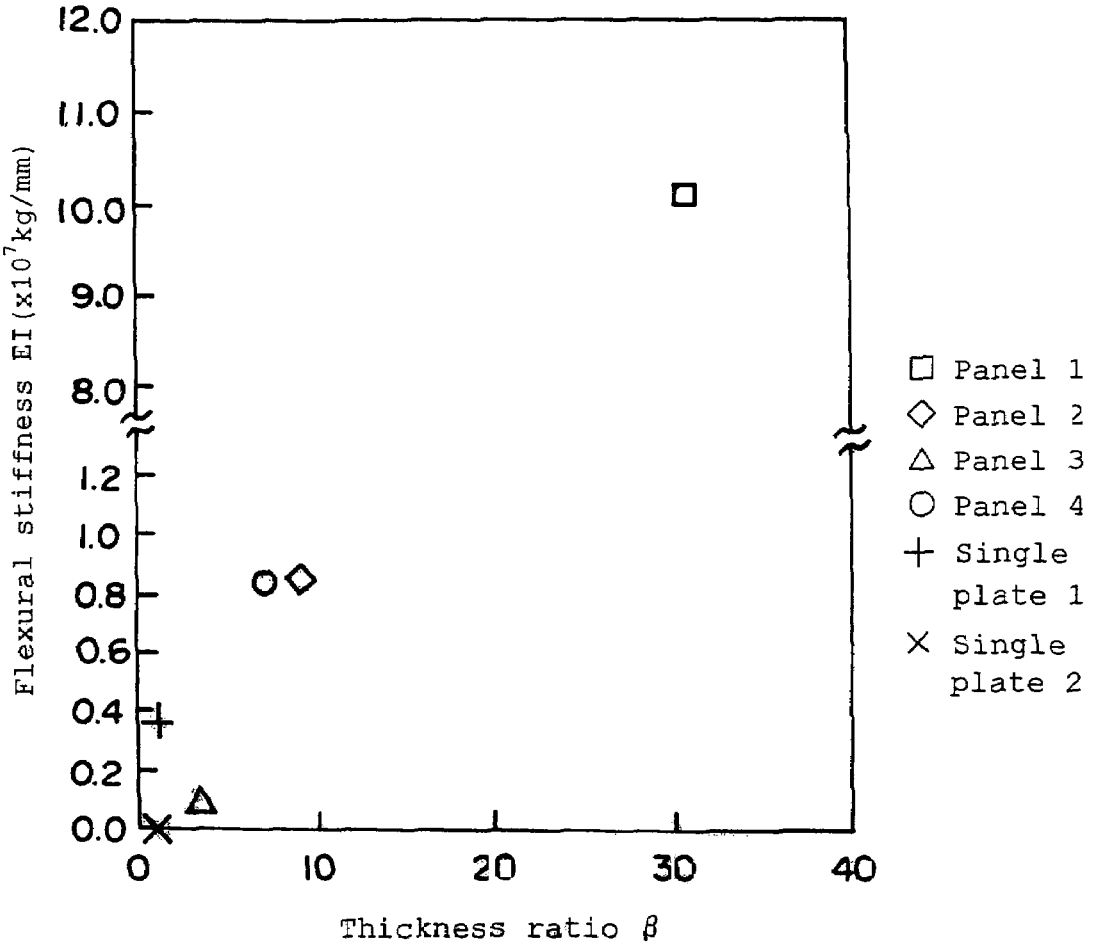
FIG. 24 is a graph showing relationships between thickness ratios and flexural stiffnesses of respective samples in Example 4 and Comparative Example 3.

FIG. 20 shows the transmission loss (dB) determined by the calculation based on mass law. FIGS. 21, 22, 23 and 24 show the result of Table 2 indicating the thickness ratio at the abscissa and the proof stress, the unit weight, the deformation degree and the flexural stiffness per unit width at the respective axes of ordinates. Based on these results, it was determined whether the respective design targets necessary for a sound insulation panel were satisfied. The result of the determination is shown in Table 3. The conditions of the flexural stiffnesses per unit width are within the range of (0.1 to 10)$\times 10^7$ kg*mm, and the conditions of the thickness ratios are within a ratio T:t1 of the total thickness of said panel T to a thickness of each skin member made of FRP t1 is within the range of 5:1 to 50:1.

The following matters are understood from the results exhibited in these Tables and Figures.

(A) The transmission loss can clear the target value over the entire range of frequency in panel 1, panel 2 (the same structure as that in Example 1), panel 3, panel 4 and single plate 1 of Example 4 as long as the unit weight is 10 kg/m$^2$ or more.

deformation can be suppressed small if the flexural stiffness per unit width is within the range of (0.1 to 10)$\times 10^7$(kg·mm). However, although panel 3 is a light sandwich panel, the proof stress (=safety factor) is 1.1, if a load of 400 kg/m$^2$ (3920 N/m$^2$) greater than 300 kg/m$^2$ (2940 N/m$^2$) is supposed as the wind load, the strength becomes insufficient. From this, it is understood that the thickness ratio β, which is determined by dividing the total thickness T with the sum of the thicknesses t1 of skin members facing each other, is necessary to be 5:1 or more.

TABLE 1

| Structure | Used substrate |
|---|---|
| A | Glass chopped strand mat (Weight: 230 kg/m$^2$) |
| B | Unidirectional woven fabric of carbon fibers (Weight: 300 kg/m$^2$), Longitudinal direction |
| B' | Unidirectional woven fabric of carbon fibers (Weight: 200 kg/m$^2$), Longitudinal direction |
| C | Glass fiber 0/90° woven fabric (Weight: 1890 kg/m$^2$) |
| C' | Glass fiber 0/90° woven fabric (Weight: 1260 kg/m$^2$) |
| CRU | 30 times foamed hard polyurethane foamed material, t = 180, 50, 15 mm |
| CRB | Balsa core with a specific gravity of 0.1, t = 38 mm |

TABLE 2

| Sample | Thickness ratio β | Unit weight Wt(kg/m$^2$) | Proof stress ratio η | Flexural stiffness per unit width EI × $10^7$(kg · mm) | Deformation degree Δ |
|---|---|---|---|---|---|
| panel 1 | 31.0 | 15.8 | 10.6 | 10.0 | 2890 |
| panel 2 | 9.3 | 13.6 | 10.3 | 0.9 | 231 |
| panel 3 | 3.5 | 10.8 | 1.1 | 0.1 | 206 |
| panel 4 | 7.4 | 14.6 | 10.7 | 0.8 | 227 |
| Single plate 1 | 1.0 | 10.2 | 0.4 | 0.005 | 62 |
| Single plate 2 | 1.0 | 6.8 | 0.2 | 0.001 | 37 |
| Target of design | 5/1~50/1 | Transmission loss: target value or more | 1 or more | 01.~10 | 200 or more |

TABLE 3

| Sample | Thickness ratio | Property of transmission loss | Proof stress ratio | Flexural stiffness per unit width | Deformation degree | Synthetic judgment |
|---|---|---|---|---|---|---|
| panel 1 | 31.0 | ○ (15.8) | ○ | ○ | ○ | ○ |
| panel 2 | 9.3 | ○ (13.6) | ○ | ○ | ○ | ○ |
| panel 3 | 3.5 | ○ (10.2) | ○ | ○ | ○ | ○ |
| panel 4 | 7.4 | ○ (14.6) | ○ | ○ | ○ | ○ |
| Single plate 1 | 1.0 | ○ (10.2) | X | X | X | X |
| Single plate 2 | 1.0 | X (6.8) | X | X | X | X |
| Target of design | 5/1~50/1 | Target value or more | 1 or more | 01.~10 | 200 or more | |

○: acceptable as design specification/
X: unacceptable as design specification
( ) Value in parenthesis: weight per unit area kg/m$^2$ (B) As to the strength (=proof stress) and the stiffness which are mechanical properties, although panel 1, panel 2, panel 3 and panel 4 of Example 4 satisfy the target values of all the proof stress η, the flexural stiffness per unit width EI and the deformation degree Δ, the single plates do not satisfy the target values even if the weights are almost the same. From this, as aforementioned, it is clarified that the sandwich structure is a structure suitable for a sound insulation panel. From the deformation degree, it is understood that the Comparative Example 1

The weight per unit area of a light concrete block of type A having a total thickness of 100 mm, which has almost the same sound-proof property, is 100 kg/m$^2$. With respect to such a light concrete, the noise level of an existing conventional concrete block sound-proof wall, which was constructed by stacking concrete blocks each having a width of 390 mm, a height of 190 mm and a thickness of 10 mm by eight in the vertical direction (total height: 1520 mm) and connecting a number of the blocks to each other in the width direction, at the time of train passing, was measured at a place distant from the sound-proof wall by 6 m using a noise meter. As a result, the noise level was 71 dB. While the height of the sound-proof wall was kept as it was 1520 mm, the sound-proof wall was cut and removed successively by each width of 800 mm. At that time, when the weight of each removed portion was measured, it was 134 kg, and the weight per unit area was 110 kg/m$^2$.

After that, the FRP sound-proof wall shown in Example 1, which had a total weight of 20.6 kg, a weight per unit area of 13.6 kg/m$^2$, a height of 1525 mm, a width of 990 mm and a total thickness of the sound-proof portion of 56 mm, was installed over 24 m, and the noise level at the time of train passing was measured at the same condition as that described above. As a result, the noise level was 70 dB, and the achievement of the same-level property was proved.

Comparative Example 2

The existing sound-proof had been constructed such that panels each having a width of 1980 mm, a height of 600 mm and a thickness of 60 mm had been stacked by three (total height: 1800 mm) between metal support poles provided at an interval of 2000 mm, a number of the panels had been connected to each other in the width direction, and cement plates made by extrusion (weight per unit area: 70 kg/m$^2$) had been used for the sound insulation panel portion of the sound-proof wall. Exchange of the wall was decided from the reason of the existence of cracks, etc., and when the noise level at the time of train passing was measured before the exchange, the noise level was 75 dB. After the removal of the existing wall, the flat-type FRP sound-proof panels, each of which has a structure shown in Example 2 in that metal pipes were inserted at both end portions in the width direction, were produced and installed (weight per unit area: 24.2 kg/m$^2$, each panel having a width of 1980 mm, a height of 900 mm and a total thickness of the sound-proof portion of 56 mm). Then, as the result of measuring the noise level at the time of train passing similarly, the noise level was 72 dB. Before and after the exchange, almost the same sound insulation property could be obtained.

Comparative Example 3

The single plate 2 prepared in Example 4 had a unit weight of 6.8 kg/m$^2$, and as is evident from the graph of the transmission loss shown in FIG. 20, it is clear that the single plate did not satisfy the target sound insulation property. Where, even in the same single plate structure, it is understood that the single plate having a unit weight of 10 kg/m$^2$ or more can satisfy the sound insulation property.

INDUSTRIAL APPLICATIONS

In the FRP sound-proof wall panel, the FRP sound-proof wall using this panel and the method for producing the same, since the sound insulation portion, which is the main structural portion thereof, is made of FRP having a strength and a ductility, it does not cause propagation of cracks due to repeated application of a small force, which is a phenomenon peculiar in a brittle material such as a conventional concrete sound-proof wall, and ultimately, occurrence of flaking and dropping of small pieces due to corrosion can be prevented. Therefore, an optimum sound-proof wall having no fear of flaking and deterioration can be provided for use in railways and roads.

Further, as compared with a concrete or a general metal such as an iron, the specific strength is high, and a great lightening can be expected while a strength necessary for a sound-proof wall is kept, and as a result, in an installation place such as a high-level bridge, the installation to the high-level place can be facilitated by making conveying of a heavy machine for lifting unnecessary, etc.

Furthermore, by providing an attachment portion to a construction body to the lower portion of the structural body, the structural body itself can be solely installed to the construction body, and as compared with a general-structured sound-proof wall requiring poles or brides separatedly, the steps and the time for installation can be suppressed small. Further, by providing a sound absorbing body on each or one of the surfaces of a sound insulation panel and forming an at least three-layer structure including a perforated panel which covers the sound absorbing body, the sound-proof effect can be further increased by using together the sound-proof wall comprising the sound insulation panel and the sound absorbing body, particularly in a case where the sound insulation property as the sound-proof wall is required at a higher level, such as a case where there is only a little space for installation, a case where apartments and housing are present more closely, a case where the weight as the sound-proof wall is restricted, etc.

The invention claimed is:

1. A sound-proof wall panel made of FRP comprising a core and skin members made of FRP positioned on both sides of said core, and having weight per unit area of 10-60 kg/m2, wherein at least one surface of said panel is formed as a rough surface in which convex parts and concave parts are disposed at random and a mean value of differences in height between said convex parts and said concave parts is 0.5 mm or more, and said rough surface is formed as a light irregular-reflection surface.

2. A sound-proof wall panel made of FRP comprising a core and skin members made of FRP positioned on both sides of said core, and having weight per unit area of 10-60 kg/m$^2$, wherein said panel has a structure with at least three layers of a sound insulation panel portion, a sound absorbing body and an FRP perforated panel portion, and a folded portion extending toward an inside portion of said panel is provided on a top of said panel, and said folded portion is molded integrally with said sound insulation panel portion.

3. The sound-proof wall according to claim 1, and a support pole which supports said panel and has an attachment portion attached to a construction at a lower position, wherein an overlapping portion is provided on a side end portion of each panel so that panels adjacent to each other partially overlap, and a packing material is filled between overlapping portions of said panels adjacent to each other.

4. The sound-proof wall according to claim 1, and a support pole which supports said panel and has an attachment portion attached to a construction at a lower position, wherein a stiffener is fixed to an outside portion of said panel or said support pole.

5. The sound-proof wall according to any of claims 1 to 2, wherein a matrix resin of said skin members made of FRP comprises a thermosetting resin containing both of a flame retardant and a damping agent or one of them.

6. The sound-proof wall panel according to any of claims 1 to 2, wherein reinforcing fibers of said skin members made of FRP comprise at least one selected from the group of glass fibers, carbon fibers and aramide fibers.

7. The sound-proof wall panel according to any of claims 1 to 3, wherein volume content of reinforcing fibers in said skin members is 15-60%.

8. The sound-proof wall panel according to any of claims 1 to 2, wherein flexural stiffness per unit area of said sound-proof wall panel is (0.1 to 10)$\times 10^7$ kg*mm.

9. The sound-proof wall panel according to any of claims 1 to 2, wherein 5-20% of the total thickness of a portion made of FRP comprises an FRP layer containing carbon fibers as reinforcing fibers.

10. The sound-proof wall panel according to any of claims 1 to 2, wherein the ration T:t1 of total thickness of said panel T to a thickness of each skin member made of FRP t1 is 5:1 to 50:1.

11. The sound-proof wall panel according to any of claims 1 to 2, wherein reinforcing ribs are provided at an interval of 10-500 mm in the vertical and horizontal directions or one of the directions for integrally joining said skin members made of FRP facing each other.

12. The sound-proof wall panel according to any of claims 1 to 2, wherein a vertical section of said panel is formed as a wave shape, a hat shape or an arc shape.

13. The sound-proof wall panel according to claim 1, wherein an FRP skin member forming said rough surface has at least two layers of a layer forming said rough surface and a lawyer for obtaining a strength and a stiffness of said panel.

14. The sound-proof wall panel according to claim 1, wherein an FRP skin member forming said rough surface has a colored layer as an outermost layer.

15. The sound-proof wall panel according to claim 1, wherein said rough surface is covered with a color gel coated layer as a brick laying pattern.

16. The sound-proof wall panel according to any of claims 1 to 2, wherein said panel comprises a perforated panel having an opening rate of 50-90%.

17. The sound-proof wall panel according to claim 2, wherein said sound insulation panel portion comprises a sandwich structural body containing a core between FRP skin member facing each other.

18. The sound-proof wall panel according to claim 2, wherein said sound insulation panel portion comprises a stiffener structural body having an FRP reinforcing material on one surface of an FRP single plate, said FRP reinforcing material substantially being integrated with said FRP single plate in its lengthwise and crosswise directions or either direction.

19. The sound-proof wall panel according to claim 2, wherein said sound absorbing body comprises a porous material.

20. The sound-proof wall panel according to claim 2, wherein said sound insulation panel portion comprises a sound insulation panel for an FRP sound-proof portion which is formed from said skin members made of FRP and said core, and a sound insulation panel for a sound-proof portion which is formed from a light transmitting material.

21. The sound-proof wall panel according to claim 20, wherein said light transmitting material is made of a polycarbonate, a tempered glass or an acrylic.

22. The sound-proof wall panel according to any of claims 1 to 2, wherein said core is made of a foamed material or a wooden material.

23. The sound-proof wall according to any of claims 3 to 4, wherein panels are connected to each other and integrated via a support pole disposed between said panels.

* * * * *

UNITED STATES PATENT AND TRADEMARK OFFICE

CERTIFICATE OF CORRECTION

PATENT NO. : 7,343,715 B2
APPLICATION NO. : 10/477604
DATED : March 18, 2008
INVENTOR(S) : Ito et al.

It is certified that error appears in the above-identified patent and that said Letters Patent is hereby corrected as shown below:

In Column 4:

At line 14, after the paragraph ending in "FRP sound-proof wall.", please insert the paragraph --FIG. 7 is a sectional view of the FRP sound-proof wall and its attachment structure portion, showing an example of attachment of the sound-proof wall depicted in Fig. 6.--.

In Column 14:

At line 10, please change "11" to --10--.

In Column 19:

At line 26, please change "13.6 $kg/mm^2$" to --13.6 $kg/m^2$--.

Signed and Sealed this

Fifth Day of August, 2008

JON W. DUDAS
*Director of the United States Patent and Trademark Office*